US006551422B1

(12) United States Patent
O'Connor

(10) Patent No.: US 6,551,422 B1
(45) Date of Patent: Apr. 22, 2003

(54) METHOD AND APPARATUS FOR TREATING METAL

(75) Inventor: John J. O'Connor, Antioch, IL (US)

(73) Assignee: Coral Chemical Company, Waukegan, IL (US)

( * ) Notice: Subject to any disclaimer, the term of this patent is extended or adjusted under 35 U.S.C. 154(b) by 0 days.

(21) Appl. No.: 09/737,991

(22) Filed: Dec. 15, 2000

Related U.S. Application Data

(60) Provisional application No. 60/172,324, filed on Dec. 17, 1999, and provisional application No. 60/171,440, filed on Dec. 22, 1999.

(51) Int. Cl.[7] ..... G21D 1/54

(52) U.S. Cl. ..... 148/509; 134/29

(58) Field of Search ..... 266/90, 78; 148/508, 148/509; 134/10, 29

(56) References Cited

U.S. PATENT DOCUMENTS

| | | | | |
|---|---|---|---|---|
| 4,325,746 A | * | 4/1982 | Popplewell et al. | 134/10 |
| 5,653,820 A | * | 8/1997 | Higashino | 134/29 |
| 5,789,359 A | * | 8/1998 | Shimozawa et al. | 134/29 |
| 5,831,855 A | | 11/1998 | Kinsman | 364/468.13 |

OTHER PUBLICATIONS

*AccuTrak® Plus™ Conductivity Controller*, EF1–04 9510, Equipment Facts, Betz Laboratories, Inc., pp. 1–5, (Dec. 1995).

*SmartScan®Plus Workstation*, EFI–029512 Betz Laboratories, Inc., pp. 1–5, (Dec. 1991).

*Software Keeps Custom Coater's Operation on Line*, Powder Coating, pp. 34–41 (Oct. 1999).

* cited by examiner

*Primary Examiner*—Scott Kastler
(74) *Attorney, Agent, or Firm*—Fitch, Even, Tabin & Flannery

(57) ABSTRACT

An apparatus for treating metal which is capable of selectively monitoring and controlling various aspects of a multi-staged metal treatment process to more accurately and reliably administer treatment. The apparatus comprises a first stage for cleaning a metal workpiece with a alkaline solution, a second stage for applying an ionic conditioner to the workpiece, a third stage for applying a phosphate solution to the workpiece, a fourth stage for applying a finishing overcoat in an ionic aqueous sealing agent to the workpiece, a plurality of sensors for monitoring temperature and conductivity of the alkaline solution in the first stage, conductivity and pH of the conditioner in the second stage, temperature, conductivity and pH of the third stage, and conductivity and pH of the fourth stage, a controller for selectively monitoring the sensors and controlling output actuators to maintain desired parameters of the metal treatment process, and capable of controlling the metal treatment process in a first and second mode of control, wherein the first mode comprises automatic controlling of the treatment process, and the second mode comprises timed controlling of the treatment process, and a plurality of output actuators for responding to the controller to maintain the desired parameters of the treatment process.

2 Claims, 31 Drawing Sheets

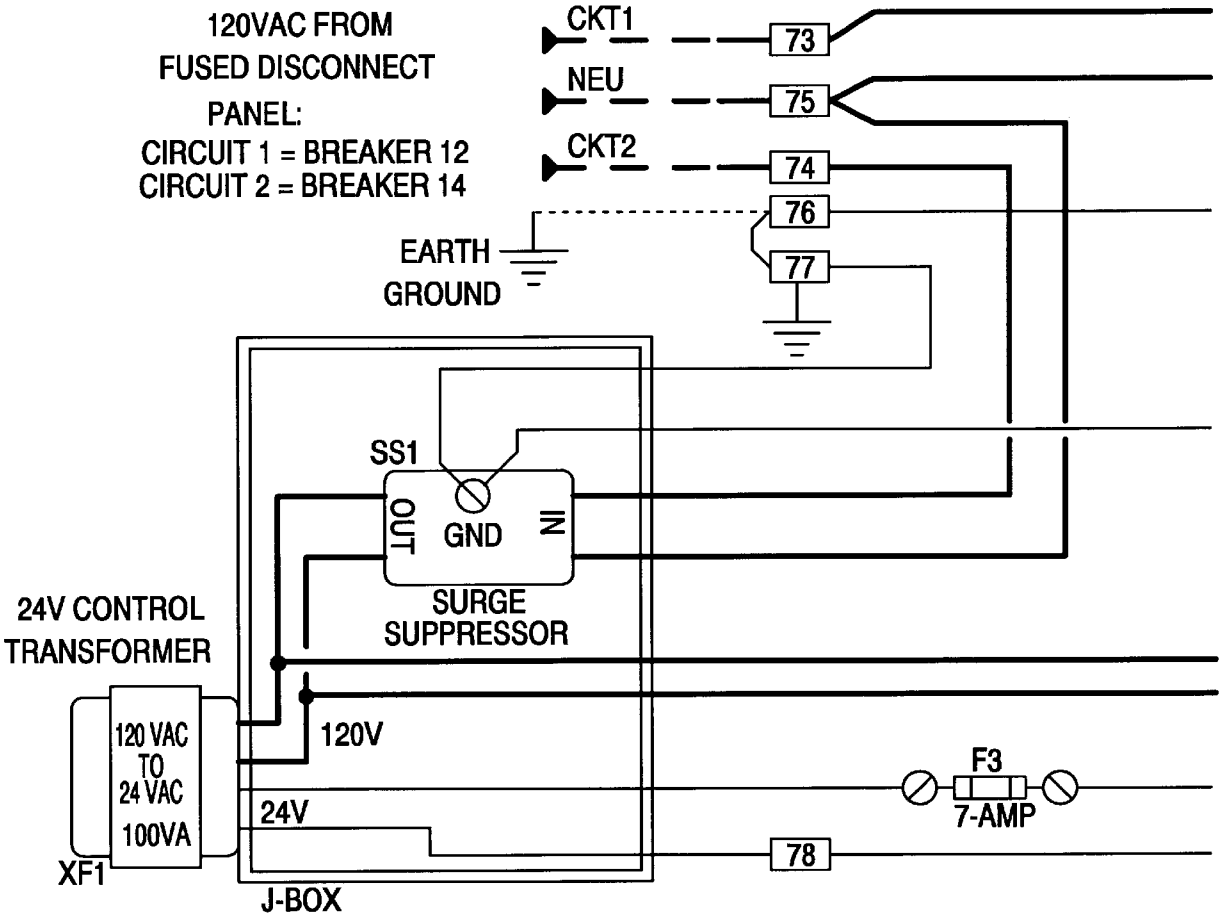
Fig. 4a1
| | |
|---|---|
| Fig. 4a1 | Fig. 4a2 |
| | Fig. 4a3 |

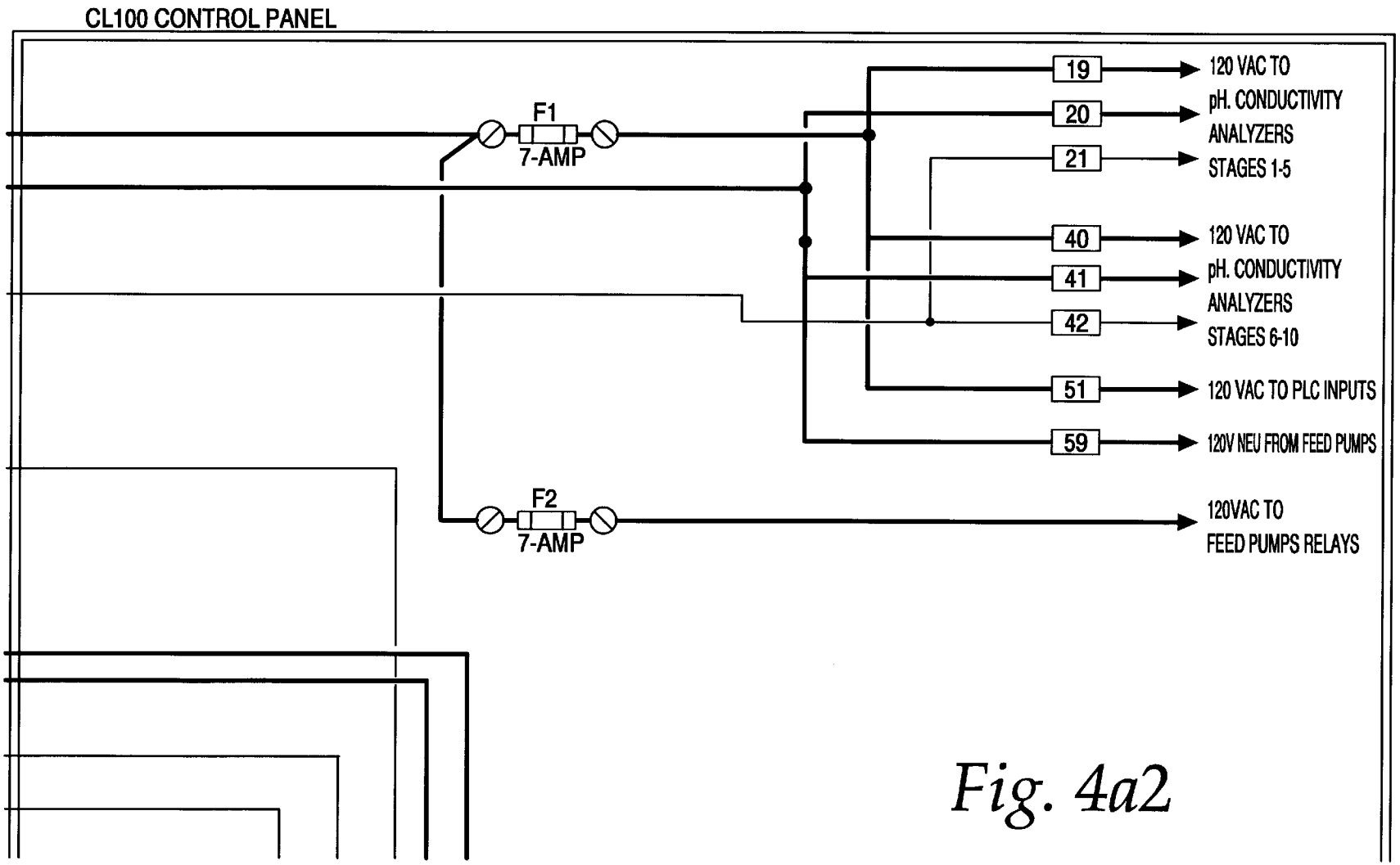
Fig. 4a2

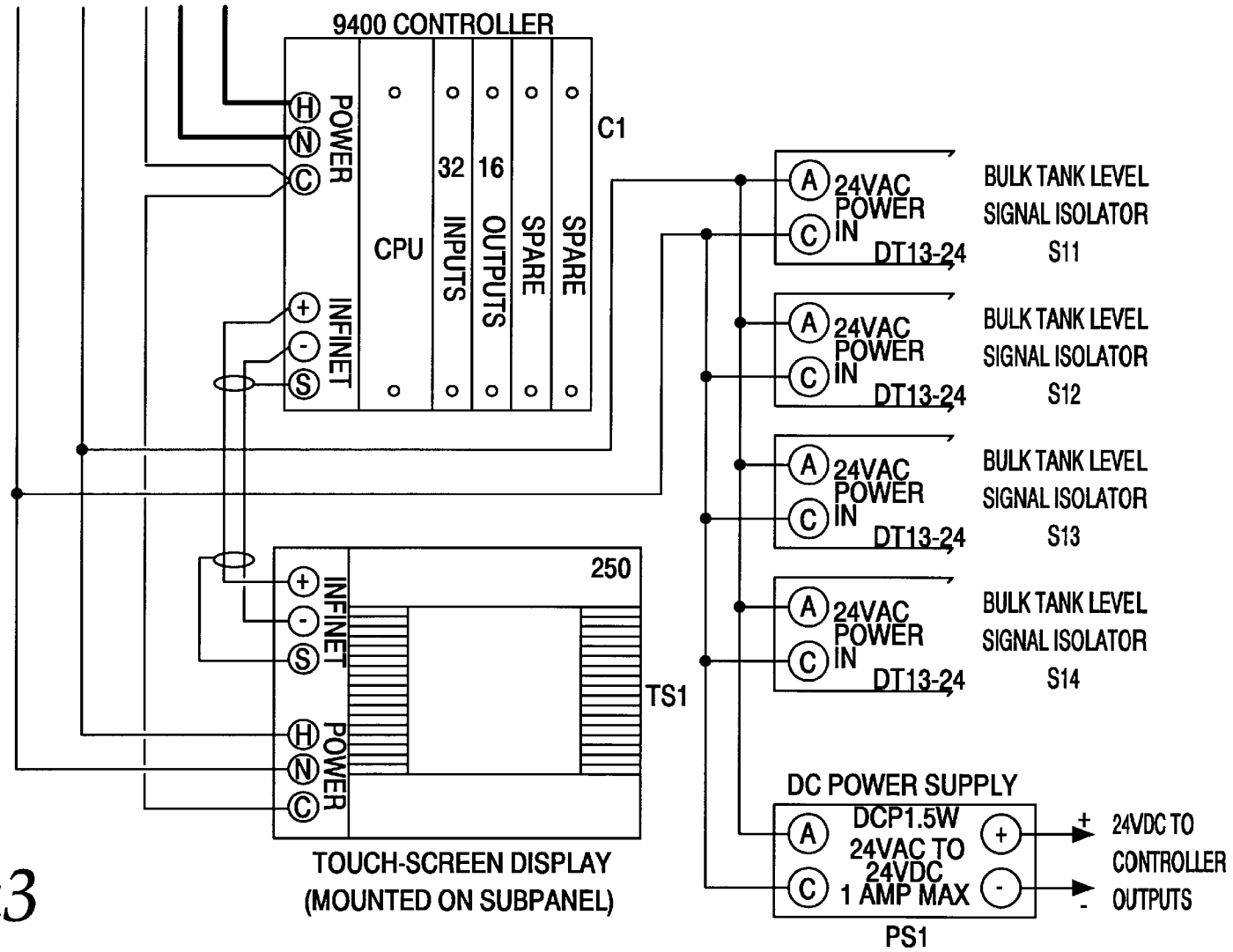
Fig. 4a3

METHOD AND APPARATUS FOR TREATING METAL

CROSS-REFERENCE TO RELATED APPLICATIONS

Priority is claimed from U.S. provisional application No. 60/172,324, filed Dec. 17, 1999, and U.S. provisional application No. 60/171,440, filed Dec. 22, 1999, which are hereby incorporated herein by reference in their entirety.

BACKGROUND OF THE INVENTION

This invention relates generally to an apparatus for treating metal and more particularly concerns an apparatus for accurately and reliably controlling a wash system that cleans and pretreats metal prior to painting.

Many manufacturers who use metal in their products require the metal to be treated prior to its use. This treatment may comprise pressing the metal, forming the metal, cleaning the metal, painting the metal, etc., or could comprise a combination of such treatments. Regardless of the required treatment, the end product must meet the specifications set forth by the manufacturer so that it can be used by the manufacturer to produce the manufacturer's products. Any delay in the treatment of the metal will likely delay the manufacturer's ability to produce its products, and will likely result in increased costs and/or loss of profits due to inefficiency. As such, it is essential that the metal treatment process operate smoothly, efficiently, and on time.

This task can often be more difficult than it sounds. For example, many manufacturers require that the metal used in their products be washed prior to its use. Typically this type of treatment requires the metal workpiece to be attached to a transportation system of some type (e.g., a conveyor or indexing system) and run through a multi-staged wash process. The wash process could include one or more soaking stages, cleaning stages, additional rinsing stages, and drying stages. If the workpiece is not monitored, and the treatment process not controlled, the metal product exiting the washing treatment process may not be cleaned to the specifications set forth by the manufacturer and may require additional washing of the metal workpiece before it can be used. Such delays cost money and loss of profits as discussed above. In addition, the metal workpiece may require further treatment once it is removed from the washing process. For example, the workpiece may also need to be painted prior to the manufacturer using it. Such additional treatment may create further demands that the washing treatment process be done correctly and efficiently.

As a solution to these problems, prior attempts have been made to monitor and control the treatment processes of metal. For example, U.S. Pat. No. 5,831,855, issued Nov. 3, 1998, to Kinsman, discloses a monitoring system for the electrostatic powder painting industry. This monitoring system senses the pH of the recycled cleaning-surface activation solution, the temperature of the curing zone, delivery container weight, and line speed. The monitoring system disclosed, however, does not monitor some of the essential parameters required in order to provide accurate and reliable control of the metal treatment process. In addition, the disclosed metal treatment control system does not provide for selective monitoring and controlling of the metal treatment process.

Another problem with the metal treatment control systems of today is that they do not provide appropriate alarm and communication systems capable of generating various types of alarms detailing when a problem occurred, in what stage it occurred, etc. Of most concern is that the systems do not provide remote access and monitoring features which allow individuals who are removed from the immediate vicinity of the treatment controlling apparatus to access, monitor, control and/or receive alarm notifications from the control system. For example, current systems for controlling treatment of metal require a plant manager, line supervisor, or line operator to go to the control system, determine what triggered the alarm, and take some corrective action to fix the situation. Typically the line operator will attempt to solve the problem. If the line operator cannot figure out a solution, the line supervisor will be called upon to try and answer the problem. If the line supervisor also cannot figure out a solution, the plant manager (or next person in the chain of command) will be called upon to correct the problem. Depending on the number of people in the chain of command this may repeat several times. This system of operation works well if the people needed to answer the problems are on-site or immediately available, however, sometimes the persons called upon to answer the problems are not in the office, (e.g., the person is on a business trip, at home, on vacation). Often this person is still called to assist in solving the problem and may be asked to come in and fix the problem if his or her assistance over the phone is not sufficient. This is not only inconvenient to the employee, but is inefficient as well.

Another problem prevalent in the metal treatment control systems of today is that the systems are subject to intentional and/or accidental tampering due to uncontrolled access to the control system. Since different people may need to have access to the control system, as discussed in the example above, modem systems do not require password protection and/or authorization codes prior to allowing persons to alter the exemplary or desired ranges/parameters set in the control system, nor do they make such systems feasible (e.g., many people have to have access in case the people in charge are out). If any of the programed values (or desired parameters) get changed, the control system may allow the treatment process to continue despite the fact that it is operating out of the required specification, (e.g., it thinks its operating within specification because the value it is using to compare the parameters to is incorrect).

Thus it is apparent that needs exist for an apparatus for controlling treatment of metal which allows for: more accurate system monitoring; selective operation; monitoring and controlling additional essential parameters of the treatment process; and remote access, monitoring and control.

SUMMARY OF THE INVENTION

An apparatus for treating metal that is capable of selectively monitoring and controlling various aspects of a multi-staged metal treatment process to more accurately and reliably administer treatment is described herein. The treatment process employs an aqueous-based system monitored and controlled by a controller that detects when various portions of the process have departed from, or are operating outside of, specified parameters and takes preventative, or corrective, action to maintain the system within the specified parameters.

In a first and second stage of the treatment process, a metal workpiece is washed by an alkaline cleanser which is monitored by the controller for temperature and solution conductivity. The controller operates output actuators, such as a chemical feed pump, to ensure that these stages are performed within the specified parameters. As the controller detects that a monitored condition is departing from, or is operating outside of, a specified parameter, the controller directs an output actuator to perform a specified function, (e.g., adding a particular chemical) so that the monitored condition returns to the desired parameter. In a third and fourth stage, the workpiece is rinsed by an aqueous solution to remove the cleanser and monitored by the controller for temperature and solution conductivity. The workpiece is then subjected to a conditioning stage whereby a water soluble ionic solution (or activator) is applied as an aqueous media and the controller monitors the conductivity and pH of the activator to ensure that the desired parameters for the treatment process are met. In a sixth stage, an iron phosphate is applied to the workpiece and the solution temperature, conductivity and pH are monitored by the controller to ensure that the proper concentration of chemicals exists so that the metal will be coated according to the desired parameters. The controller may activate output actuators to assist it in maintaining the parameters. The workpiece is then subjected to seventh and eighth rinse stages where the controller monitors the conductivity of the rinsing solution. In a ninth stage of the treatment process, a finishing overcoat is applied as an ionic aqueous sealing agent over the phosphate layered workpiece and the controller monitors the conductivity and pH values of the agent to maintain proper concentration of chemicals and conform with the specified parameters of the treatment system. Lastly, the workpiece is rinsed with de-ionized water while the controller monitors the rinse solution's conductivity.

More particularly, the metal treatment controlling apparatus comprises sensors for monitoring parameters of the multi-staged process at various stages throughout the process. In keeping with the invention, the sensors may comprise pH sensors, conductivity sensors, temperature sensors, pump sensors, etc. Such sensors provide valuable feedback from various stages of the metal treatment process and allow the stages, as well as the system as a whole, to be monitored and run more efficiently. In particular, a conductivity sensor can be used throughout all stages of the treatment process to ensure that the process is conforming to the desired parameters, (e.g., monitoring conductivity to determine solution concentration and/or contamination).

The apparatus further comprises a controller for selectively monitoring the sensors and controlling the metal treatment process to ensure that the treatment is applied according to desired standards throughout. The controller provides at least a first mode and a second mode of controlling the metal treatment process. In the first mode, the controller offers automatic control of the metal treatment process, thereby allowing the system to monitor the process automatically and/or react automatically to the data received from the sensors. In the second mode, the controller offers timed control of the metal treatment process, which results in specified tasks being performed at predetermined time intervals. A combination of automatic and timed controlling can also be achieved so that different stages of the metal treatment process can be set up to run differently, (e.g., one stage can be set for automatic, while another can be set for timed).

The metal treatment control apparatus also comprises output actuators which perform tasks specified by the controller to ensure that the treatment process continues to run within the desired parameters. In keeping with the invention, the output actuators may comprise feed pumps, alarms, conveyor motors, sprayers, ovens, etc. Such output actuators provide the controller with valuable tools to take action to keep the system operating within the desired parameters. For example, if the controller receives input from the sensors indicating that a particular parameter is straying from its desired value, (e.g., pH is straying from the desired pH range), then the controller, via the output actuators, can take corrective or preventive action to keep the particular parameter within its desired value, (e.g., add pH-adjusting chemical to get pH parameter to desired range/value).

The apparatus for controlling treatment of metal may also comprise a communication device capable of generating various types of alarms, (e.g., pH value has strayed from the desired range/value), and further capable of providing remote access to the control apparatus so that individuals who are removed from the immediate vicinity of the treatment controlling apparatus can access, monitoring and/or control system from wherever they are. In addition to notifying the individuals working on or near the treatment controlling apparatus to see and/or hear an alarm, the communication device also can be set up to notify someone off site or away from the apparatus. Additional parties, such as the apparatus manufacturer, may be notified of the alarm and/or allowed to access the apparatus so that they might provide better customer service or assistance.

The apparatus for controlling treatment of metal may also comprise a security component which requires entry of a password or authorized code in order to gain access to the apparatus and/or alter the desired values or parameters. Such a feature serves to minimize the risk of accidental or intentional tampering with the specification settings (or desired parameters) and assist the apparatus in providing accurate and reliable monitoring and/or control of the treatment process.

BRIEF DESCRIPTION OF THE DRAWINGS

Other objects and advantages of the invention will become apparent upon reading the following detailed description and upon reference to the drawings, in which:

FIGS. 4*a*1, 2, 3–n are partial schematic diagrams of the electronics located within the control panel of FIG. 3;

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1A:
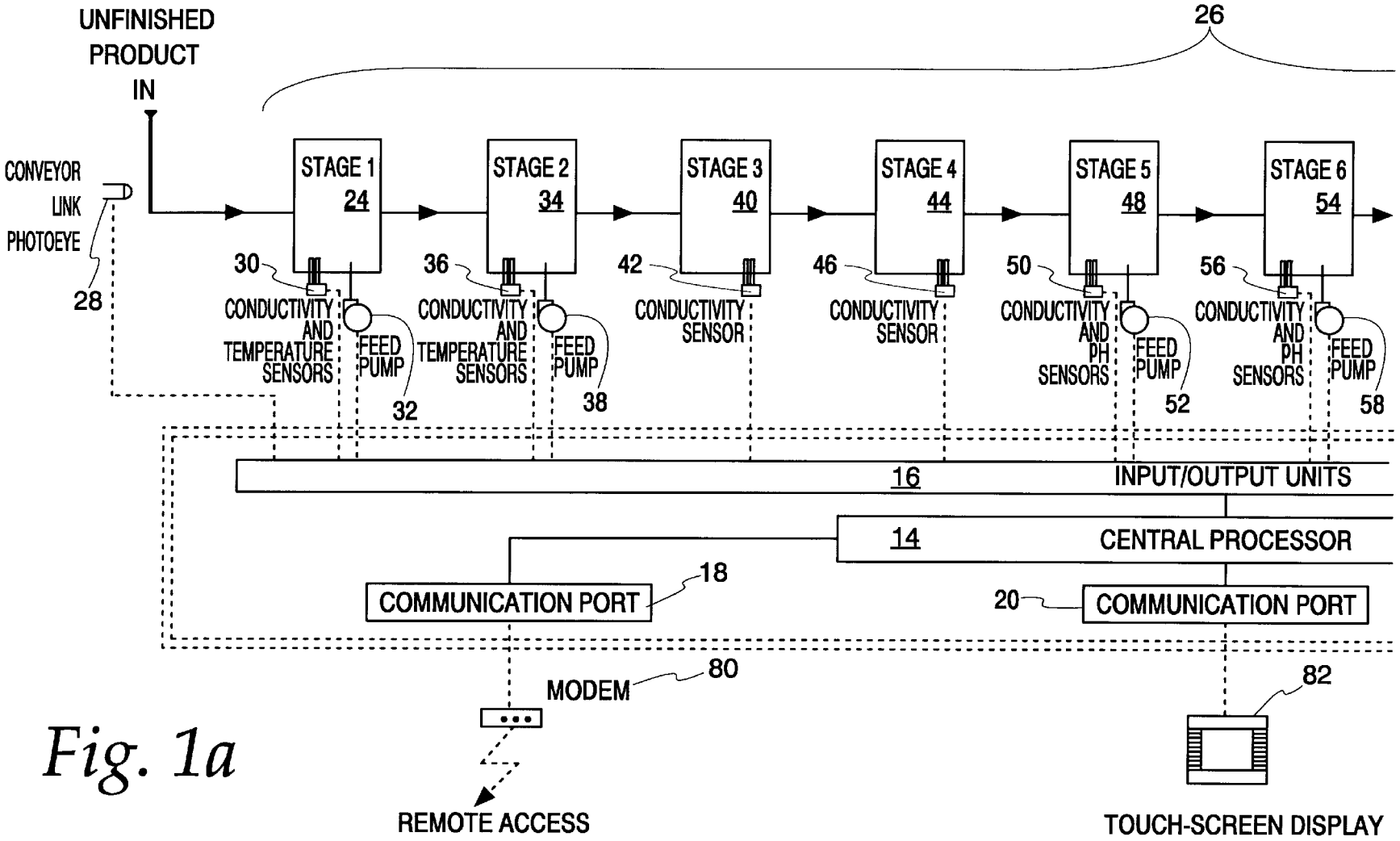
FIGS. 1*a* and 1*b* are block diagrams of an apparatus for controlling treatment of metal according to the invention.
Figure 1B:
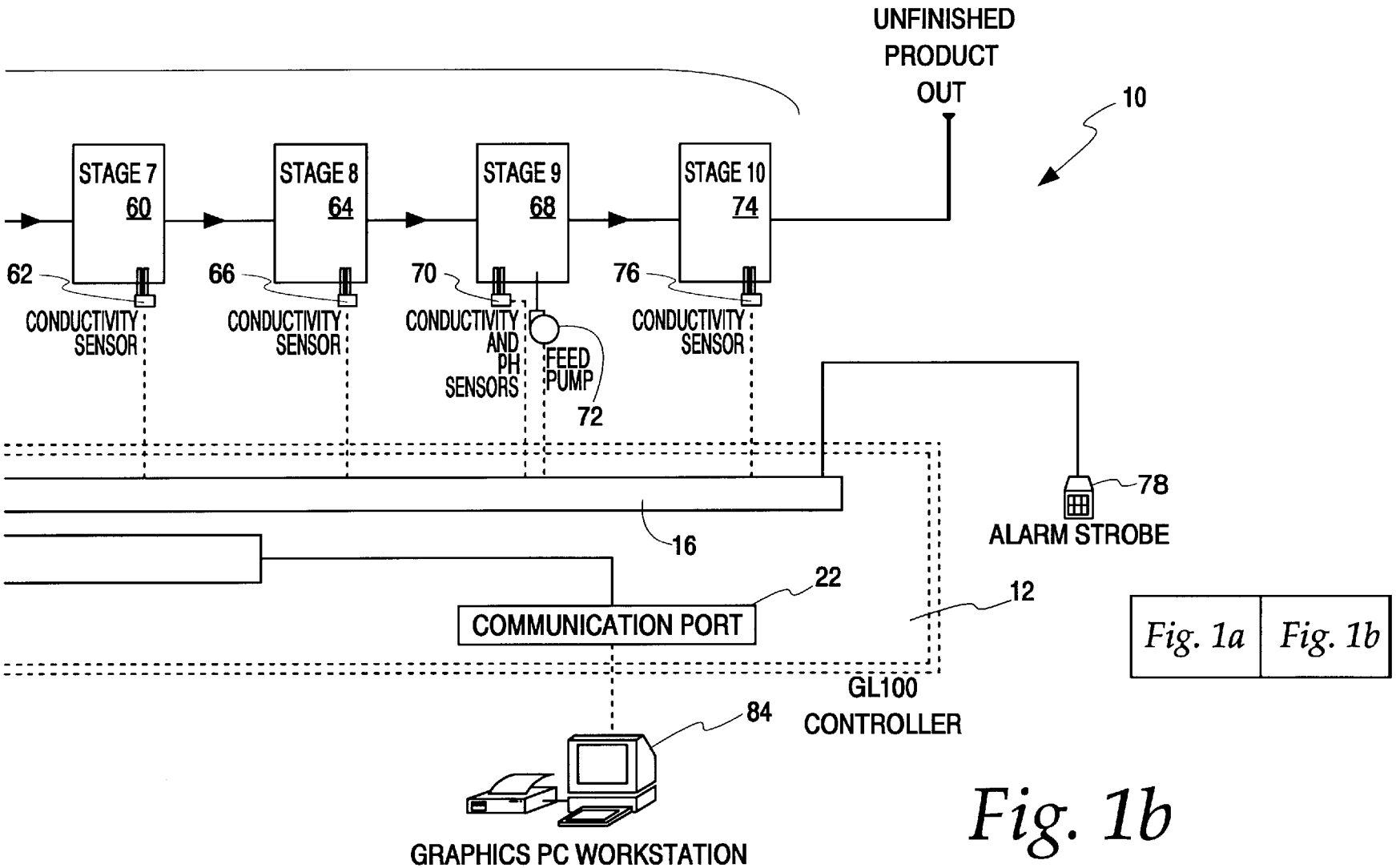

Referring now to the drawings and especially to FIG. 1, in which an apparatus for controlling treatment of metal is generally shown at reference numeral 10 and includes a controller 12 comprising a central processor unit (CPU) 14, input/output units 16, and communications ports 18, 20 and 22. Unfinished products, (e.g., pretreatment metal workpieces), are attached to a transportation system (not shown), such as a conveyor, and delivered to the first stage 24 of a multi-staged metal treatment process 26. The apparatus 10 is equipped with a optical sensor 28 (e.g., conveyor link photoeye) to monitor the conveyor for parts and/or speed. The first stage 24 is a cleansing stage in which the workpiece or unfinished product is cleansed. During this stage, conductivity and temperature sensors 30 monitor the conductivity and temperature of the bath or cleaner solution. The conductivity is used during this stage to control the cleaner solution concentration. This stage is also equipped with a feed pump 32 with which the controller 12 can add cleaner solution from the bath. In general, the feed pumps are chemical feed pumps which are controlled by the system to maintain a particular solution parameter at its setpoint, (e.g., a desired parameter value). The pump feed mode for each pump can be selected to be one of: auto, timed, or off.

When in the auto mode, the pump is controlled in response to the system, (e.g., the pump adds cleaner solution only when the sensors 30 indicate that such is needed). According to this mode, the pump will be ready to run when the feed pump switch is in the auto position, the system is running, and the system parameter being controlled has a valid reading, (e.g., when sensors have detected that the pump should be turned on). If the pump is ready to run, it will start running once the controlled parameter is at least a certain fixed value from its setpoint for a predetermined amount of time. In other words, if the pump is set to start running when the controlled parameter remains at least two values above or below the setpoint for a period of thirty seconds or more, it will begin running once the sensors 30 indicate that the controlled parameter is two values above where it is suppose to be, (e.g., above the setpoint), for thirty seconds or more. The pump will continue to run until the controlled parameter reaches its setpoint. Once the setpoint is reached, the pump will shut off after a predetermined amount of time has passed. If at any time, the pump becomes not ready to run it will shut down immediately.

When in the timed mode, the pump is run for a set timed interval and off for a set timed interval. According to this mode, the pump will be ready to run when the feed pump switch is in the timed position, the system is running, and the system parameter being controlled has a valid reading. When the pump is ready to run, it will run for the present on time and stop for the preset off time.

When in the off mode, the pump is not started.

The auto mode is the most beneficial mode to have the chemical feed pumps in, but there are circumstances where the system will get out of line. These circumstances are a direct result of metal being processed through the washer. For example, during a cleaning stage, a buildup of soils will cause an imbalance between the actual concentration and the required concentration. For this reason, a buffer range is incorporated into the chemicals, and the controlling system itself, to minimize the imbalances.

In the first stage 24, the feed pumps are started when sensors 30 detect that the conductivity is below its setpoint for thirty seconds. The pumps continue to run until the conductivity is at or above the setpoint for a minimum of thirty seconds. If the sensors 30 are not working, or are working improperly, the feed pump switch can be set to timed so that cleaner solution will be added at predetermined timed intervals. A "washer ready" input may also be equipped to the controller 12 so that workpieces will not be run through the first stage 24 until the stage is properly running.

The workpiece is then conveyed or transported to the second stage 34 in which a second cleansing process is begun. As with the first stage 24, the second stage 34 uses conductivity and temperature sensors 36 to monitor the conductivity and temperature of the cleaner solution. A feed pump 38 is also equipped to this stage so that the controller 12 can add cleaner solution as needed. The feed pumps 38 are started when sensors 36 detect that the conductivity is below its setpoint by a predetermined amount for a maximum of thirty seconds (or other predetermined time interval). The pumps continue to run until the conductivity is at or above the setpoint for a minimum of thirty seconds. If the sensors 36 are not working, the controller 12 can be switched from auto to timed mode so that cleaner solution will be added after a predetermined time interval. Again, a "washer ready" input may be equipped to the controller 12 so that workpieces will not be run through the stage until it is ready.

The first two stages 24 and 34 are cleaning stages which are controlled by monitoring the conductivity within the chemical bath solution. When either cleaner chemicals or soils removed by the cleaner (from the metal workpiece) enter the bath solution, the conductivity increases. Upon initial charge of the chemical bath solution with adjustment to the correct concentration, the solution achieves a conductivity value. To maintain the initial concentration of the cleaner, the setpoint on the controller should be set at or just slightly above the charge-up conductivity value.

Although the apparatus 10 provides for automatic control and chemical feed, manual titration checks should still be performed because it is from these titrations that the user determines whether the apparatus 10 is controlling properly. For example, if the manual titration shows that the chemical concentration is lower than the required range, it is an indication that some of the chemical bath solution has been carried out, or that there has been soil buildup within the bath solution. In either case, the controller may need to be adjusted. Whether or not an adjustment is needed depends on how the controller setpoint is oriented. Since the chemical solution adds conductivity to the solution, a setpoint conductivity value that is lower than the actual solution conductivity value would mean that no more chemical need be pumped. This is because the controller has determined from the input received from the conductivity sensors that there is enough chemical in the bath due to the fact that the actual conductivity value is greater than the setpoint conductivity value. However, the fact of the matter is that the conductivity value exists due to the presence of the chemical solution and removed soils from the metal workpiece. After a period of time, it is possible for enough soils to have accumulated making the solution conductivity value climb above the setpoint conductivity value. With such a reading, no chemical solution would be added. Therefore, a setpoint conductivity value adjustment should be performed. The conductivity value setpoint should be set higher than the solution's conductivity value. The exact amount above depends on how low the concentration is, the amount of soils in the solution, and the size of the bath tank. This will require experimentation and may be very difficult to overcome in certain circumstances, (e.g., if there are a lot of soils buffering the chemical in a large tank).

| | Titration indicates low chemical concentration (low chem. concentration) | Titration indicates high chemical concentration (high chem. concentration) |
|---|---|---|
| Setpoint conductivity value is less than the solution conductivity value (Setpoint < Solution) | Adjust the setpoint value above the solution value | Leave bath alone and allow concentration to drop |
| Setpoint conductivity value is greater than the solution conductivity value (Setpoint > Solution) | Add chemical solution (if concentration does not rise adjust setpoint up slightly) | Adjust setpoint even with solution (if concentration is too high) otherwise leave alone. |

The workpiece is then transported to the third stage 40 in which the first of two rinse cycles is begun. In the third stage 40, conductivity sensor 42 monitors the conductivity of the rinsing solution. The conductivity is used to monitor contamination. This stage is also monitored for alarm purposes. If the conductivity exceeds a set limit, the controller 12 will activate an output actuator alarm 78 notifying the operator or other individual that contamination has occurred.

After the workpiece is run through the third stage 40, it is transported to the fourth stage 44 and begins another rinse cycle. In the fourth stage 44, conductivity sensor 46 monitors the conductivity of the rinsing solution. As in the third stage, the conductivity is used to monitor contamination. The controller 12 monitors the input received from sensor 46 and will activate an output actuator alarm 78 notifying the operator or other individual that contamination has occurred if the conductivity exceeds a set limit.

The workpiece is then transported to the fifth stage 48 in which an activator or conditioner solution is applied. In the fifth stage 48, conductivity and pH sensors 50 monitor the conductivity and pH value of the activator solution. During this stage, conductivity is used to monitor contamination, and pH is used to control the additions of a pH-adjusting chemical to maintain the activator pH value. This stage is also equipped with a feed pump 52 with which the controller 12 can add pH-adjusting chemical to maintain the activator pH value. As mentioned above under the first and second stage 24 and 34, a "washer ready" input may also be equipped to the controller 12 so that workpieces will not be run through the fifth stage 48 until the stage is properly running.

In general, an activator (or conditioner) stage is typically run before a treatment stage to aid in obtaining lower coating weights and small phosphate crystals. Maintaining a conditioner stage is actually quite different than controlling a cleaner or phosphate stage (see sixth stage 54) due to the nature of the conditioner chemical itself. The conditioner is a very fine powdered material that needs to be made up into a slurry before it is added to the chemical processing conditioner tank. Since the condition is a powder it cannot be pumped, and the best way to get the material into a tank is by making the powder into a slurry and pumping the slurry into the tank. The concentration of such a mixture is typically listed as parts per million of condition in the tank.

Conditioners can also be very beneficial to obtaining good physical results from a zinc phosphate treatment, (see sixth stage 54), however, in order to achieve good results, the condition must be maintained properly. According to a preferred embodiment, the conditioner should be maintained at a pH range of 8.8 to 9.2 while additionally being maintained at the correct concentration. Since the conditioner is primarily added manually to the processing tank, the only thing that is really controlled by automation is the pH range. In order to do this, the pH-adjusting chemical must be controlled so that chemical is added incrementally to maintain the correct pH range. Conditioners differ from pH-adjusting chemicals in that the pH will naturally drop, in the case of conditioners, due to carry-out and depletion of the concentration. However, the pH-adjusting chemical has a high pH and will raise the pH to where it needs to be. Therefore, deciding on a setpoint is basically all that needs to be done in order to control the conditioner. There is not any real strategy for maintaining pH like there is with managing conductivity. Basically, whenever the pH drops, the controller 12 simply pumps pH-adjusting chemical into the tank until the pH is restored to the desired range of pH values. This will be a constantly repeating cycle for the conditioner stage as long as the stage is in the auto mode and there is pH-adjusting chemical available for the controller to pump into the tank. According to a preferred embodiment, the pH setting for the condition would be 9.0. As mentioned above, the feed pumps 50 are started when the fifth stage 48 pH value is below its setpoint for a maximum of thirty seconds, and run until the pH is at or above the setpoint for a minimum of thirty seconds. As also mentioned above, the pH-adjusting chemical can be added by timer if the auto sensors 50 fail.

The workpiece is then transferred to the sixth stage 54 in which a zinc phosphate or iron phosphate solution is applied. In the sixth stage 54, conductivity and pH sensors 56 monitor the conductivity and pH value of the activator solution. During this stage, conductivity is used to control the zinc phosphate concentration, and pH is monitored as a guide to the operator. This stage is also equipped with a feed pump 58 with which the controller 12 can add zinc phosphate to maintain the zinc phosphate concentration. When the pump is set to auto mode and ready to run, the pump will be started when the solution conductivity value of the sixth stage 54 is below the system setpoint for this parameter for a maximum of thirty seconds, and will run until the conductivity is at or above the setpoint value for a minimum of thirty seconds. When the pump is set to timed mode and ready to run, the pump will be started and stopped at the preset time intervals which are based off of a production schedule. As is mentioned above, a "washer ready" input may also be equipped to the controller 12 so that workpieces will not be run through the sixth stage 54 until the stage is properly running.

Zinc phosphate stages are also controlled by monitoring conductivity within the chemical bath solution, but pH and an acid ratio are critical values to be aware of when running a zinc phosphate stage, and must therefore be monitored as well. The pH of the bath solution determines how acidic the solution is. The acidity of the solution is affected by how much metal is processed and how much chemical is added to replenish the bath solution. The more metal processed through the system, the quicker the concentration is used up. Not only does the concentration or total acid have to be controlled by conductivity, but the fee acid must also be kept in a certain range as well. The ratio of total acid to free acid gives us the acid ratio that needs to be controlled in order to run the zinc phosphate solution successfully. Upon initial charge of the chemical bath solution, (with adjustment to correct the total acid and free acid values), the solution achieves a conductivity value. To maintain the initial total acid of the zinc phosphate, the setpoint on the controller system should be set at or slightly above the charge-up conductivity value.

Running a zinc phosphate solution takes a delicate balance to keep the total acid and free acid in their correct ranges. Such a task does not only take proper chemical replenishment, (including the accelerator chemical), to keep the balance, but further requires that a certain amount of metal be run through the stage to use up the acidity as well. For this reason, manual titrations should continue to be taken to determine whether the controlling system is controlling and maintaining the zinc phosphate solution properly. Once this balance has been achieved, the conductivity setpoint value becomes the critical component for keeping the balance. This value must be kept so that the total acid and free acid are maintained in their proper ranges by replenishment. Too much acid will cause a low total acid to free acid ratio, which may result in a poor phosphate coating due to the phosphate being too aggressive. Too little acid replenishment will cause a higher ratio, which may result in a poor coating due to the high ratio which would not allow for the chemical to react correctly. Correct replenishment rates will keep the total acid and free acid very close to the correct range.

The total acid can be controlled by the conductivity setpoint, but there may be a circumstance where the total acid and free acid have one reading in the correct range and the other out of range, or both out of range. If the total acid is out of range and the free acid is within range, the situation is treated like a cleaner bath concentration (discussed above under the first and second stages 24 and 34) and the conductivity setpoint is adjusted accordingly to bring the total acid back into range. After this action has been performed, the free acid is checked to verify that it too is alright, and if it is not, then the system is adjusted manually by following the operating bulletin for the product. Whenever the free acid is out of range, but the total acid is fine, it is easiest to correct the free acid manually as well. When both the total acid and free acid are out of range, the system is altered differently. For example, if the setpoint conductivity value is less than the solution conductivity value and both the total acid and free acid values are high, the controller 12 adds pH-adjusting chemical to lower the free acid value and the both acids are rechecked. In such a scenario, the setpoint is left alone. If both the total acid and free acid values are high, the controller raises the setpoint value above the solution conductivity value and rechecks the acids to verify their ratio. If the total acid value is high and the free acid value is low, the controller 12 will add the pH-adjusting chemical if the free acid value is too low and coating is poor, and will recheck the acid values. In such a scenario, the setpoint is left alone. Lastly, if the total acid level is low and the free acid level is high, the controller 12 will raise the setpoint value above the actual conductivity value of the solution and will add the pH-adjusting chemical to lower the free acid value. The controller 12 will also recheck the acid values.

If the setpoint conductivity value is greater than the solution conductivity value and both the total acid and free acid values are high, the controller 12 will lower the setpoint below the solution conductivity value and add the pH-adjusting chemical to lower the free acid value and the acid ratio. If both the total acid and free acid values are low, the controller 12 will correct both values and leave the setpoint value alone. The acid values will then be rechecked. If the total acid value is high and the free acid value is low, the controller 12 will lower the setpoint value below the solution conductivity value and add the pH-adjusting chemical if the free acid value is low and the solution coating is poor. If the total acid value is low and the free acid value is high, the controller 12 will add the pH-adjusting chemical to the solution to lower the free acid value and will recheck the acid values. In such a scenario, the setpoint value will not be disturbed.

| | Total Acid - hi<br>Free Acid - hi | Total Acid - lo<br>Free Acid - lo | Total Acid - hi<br>Free Acid - lo | Total Acid - lo<br>Free Acid - hi |
|---|---|---|---|---|
| Setpoint conductivity value is less than the solution conductivity value | Add pH-adjusting chemical to lower free acid | Raise setpoint above the solution conductivity value | Add product if free acid is too low and coating is poor | Raise setpoint above the solution conductive value and add pH-adjustment chemical |
| Setpoint conductivity value is greater than solution conductivity value | Lower setpoint below the solution conductivity and add pH-adjusting chemical | Leave setpoints alone | Lower setpoints below solution conductivity and add product if free acid is low and coating is poor | Leave setpoints alone and add pH-adjusting chemical to lower free acid |

One final control procedure for the zinc phosphate stage is the addition of accelerator into the zinc phosphate solution. The accelerator acts like a catalyst and is a required for the process of steel in a zinc phosphate bath.

According to a preferred embodiment, the accelerator is controlled by setting the feed pumps to timed mode. By running in the timed mode a certain amount of chemical is added for "x" number of minutes (or other period of time) and not added for "y" minutes. In order to add the corrected amount of accelerator each day, figure out how much needs to be added over the course of a production day. Once that has been figured out determine how much of the amount needs to be added each for one minute. Once the feed pump amount and the amount of accelerator needed per day is figured out, determine how many minutes the pump should be on and off for in a given hour. For example, if you need 8000 mls of accelerator per day and your pump is set to pump 500 mls of accelerator per hour, then the timed mode should be set at one minute on and thirty minutes off. This will give you roughly 8000 mls of accelerator per day during an eight-hour day.

The workpiece is then transported to the seventh stage 60 in which the first of two additional rinse cycles is begun. In the seventh stage 60, conductivity sensor 62 monitors the conductivity of the rinsing solution. The conductivity is used to monitor contamination. This stage is also monitored for alarm purposes. If the conductivity exceeds a set limit, the controller 12 will activate an output actuator alarm 78 notifying the operator or other individual that contamination has occurred.

After the workpiece is run through the seventh stage 60, it is transported to the eighth stage 64 and begins another rinse cycle. In the eighth stage 64, conductivity sensor 66 monitors the conductivity of the rinsing solution. As in the seventh stage 60, the conductivity is used to monitor contamination. The controller 12 monitors the input received from sensor 66 and will activate an output actuator alarm 78 notifying the operator or other individual that contamination has occurred if the conductivity exceeds a set limit.

The workpiece is then transported to the ninth stage 68 in which an chrome sealing solution is applied. In the ninth stage 68, conductivity and pH sensors 70 monitor the conductivity and pH value of the sealing solution. During this stage, conductivity is used to monitor contamination, and pH is used as a guide to the operator. The chrome is added by timer based off of preset time increments. This stage is also equipped with a feed pump 72 with which the controller 12 can add pH-adjusting chemical to maintain the sealing solution pH value. As mentioned above under the first, second, fifth and sixth stages (24, 34, 48 and 54) a "washer ready" input may also be equipped to the controller 12 so that workpieces will not be run through the ninth stage 68 until the stage is properly running.

In general, a chrome final sealing stage is controlled very similar to how an accelerator stage (see fifth stage 48 above) is controlled. The chrome seal is usually the final chemical treatment that a part will be processed through within a finishing system. Its primary function is to provide a seal over the fresh phosphate coating, but the chrome seal also serves to provide maximum corrosion resistance to the metal once it has been completely processed through the finishing system and painted. Chrome is a vital ingredient in achieving increased salt spray resistance.

According to a preferred embodiment, the chrome sealing stage 68 is controlled by adding the sealing solution with the feed pumps 72 set to timed mode so that the total amount of chrome that can be added per day can be controlled. By running the feed pumps 72 in the timed mode, a certain amount of the sealing chemical will be added for an "x" amount of time and not added for a "y" amount of time. In order to add the correct amount of chrome each day, the operator calculates how much chrome is added over the course of a production day. After determining the daily amount, the operator calculates how much is used per hour, and determines how much the chemical feed pumps 72 pump per minute. The operator next calculates the amount of time the pump is on and off per hour. For example, if the system needs 8000 mls of accelerator per day and the pump 72 is set to pump 500 mls of chrome per hour, the timed mode should be set at one minute on and thirty minutes off so that approximately 8000 mls of chrome is used during the eight hour work period.

The pH value is also monitored electronically within the chrome final sealing stage 68. Maintaining a proper pH range is important so that the pH does not get too low and start to remove the phosphate coating. According to a preferred embodiment, the pH range is 3.8 to 4.0. This range can be maintained by using the same pH-adjusting chemical used to adjust the conditioner stage 48. The pH will naturally drop, therefore increments of the pH-adjusting chemical need to be added periodically to maintain the proper pH value.

The workpiece is then transported to the tenth stage 74 in which an additional rinse cycles is begun. In the tenth stage 74, conductivity sensor 76 monitors the conductivity of the rinsing solution. The conductivity is used to monitor contamination. This stage is also monitored for alarm purposes. If the conductivity exceeds a set limit, the controller 12 will activate an output actuator alarm 78 notifying the operator or other individual that contamination has occurred.

The apparatus 10 of FIG. 1 also comprises a communication device which is capable of generating various types of alarms, (as discussed above), and further capable of providing remote access to the control apparatus via a modem 80 so that individuals who are removed from the immediate vicinity of the treatment controlling apparatus 10, (e.g., off-site personnel), can access, monitor and/or control the system from wherever they are. In addition to notifying the individuals working on or near the treatment controlling apparatus 10 to see and/or hear an alarm 78, the communication device also can be set up to notify someone off site or away from the apparatus 10 about alarms via the modem 80.

The remote access to the apparatus 10 may also be set up to allow for additional parties, such as the apparatus manufacturer, to be notified of any alarms and/or to gain access to the apparatus 10 so that they might provide better customer service or technical assistance.

Additional communication terminals 82 and 84 may be provided to allow access to the apparatus 10 from various other locations. For example, communication terminal 82 is depicted as a touch-screen display which would offer an operator access to the controller 12 to alter or monitor setpoint parameter values. Similarly, communication terminal 84 is depicted as a graphics personal computer workstation with attached printer. Such a terminal would allow an operator to access or monitor the apparatus 10, and would also allow the operator to print out reports, logs, or specification settings from the terminal for use elsewhere. These terminals 82 and 84 could provide on-line personal computer interface with the apparatus 10 to line operators, supervisors, etc.

The apparatus 10 of FIG. 1 may also comprise a security component which requires entry of a password or authorized code in order to gain access to the apparatus and/or alter the desired values or parameters. Such a feature serves to minimize the risk of accidental or intentional tampering with the specification settings (or desired parameters) and assists the apparatus 10 in providing accurate and reliable monitoring and/or control of the treatment process. Therefore, with an authorized password an operator can view the current status of all areas being monitored by the apparatus 10, including washer tanks, feed pumps, parts tracking, conveyor status, waste treatment, oven control, etc., and change or control parameters associated with each.

Figure 2:
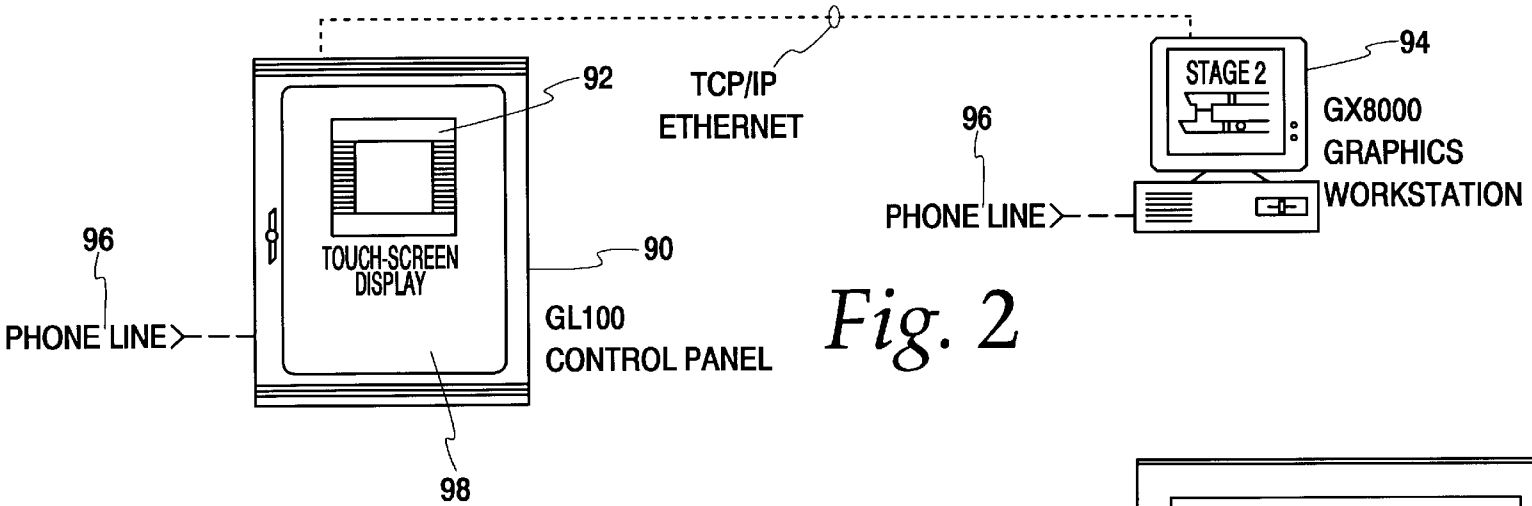
FIG. 2 is a block diagram of a system configuration setup for the apparatus of FIG. 1.

Turning now to FIG. 2, in which a block diagram of a system configuration setup for the apparatus 10 of FIG. 1 is shown. According to this configuration, a control panel 90 houses the controller 12 and provides a touch panel input 92 so that an operator can monitor and control the treatment of metal according to the invention. The control panel 90 is connected to a graphics work station 94 via a network (e.g., Ethernet), thereby allowing additional monitoring and controlling of the treatment process from another location. Both the control panel 90 and work station 94 are equipped to connect to a phone line 96 so that remote access to the system can be achieved. The control panel 90 may further comprise a removable portion 98 whereby access to the controller 12 may be obtained.

Figure 3:
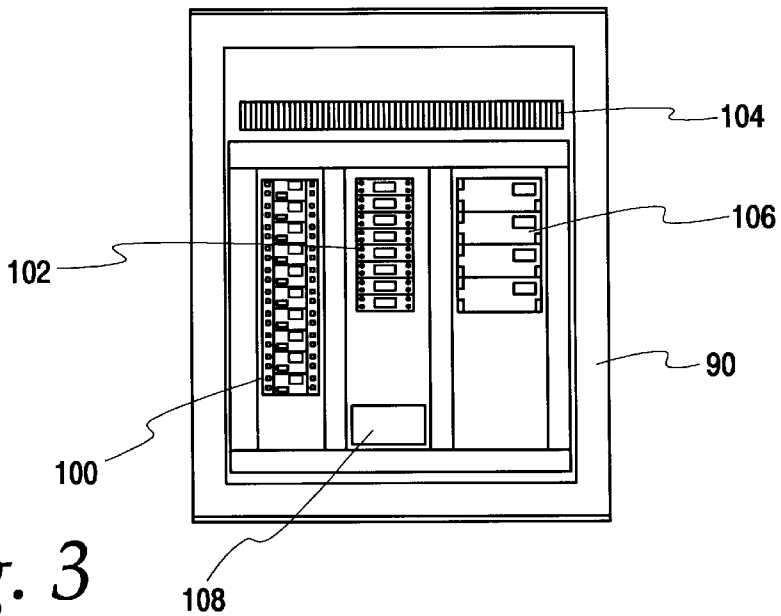
FIG. 3 is an elevation view of the control panel depicted in FIG. 2 with the removable portion of the panel removed.

In FIG. 3, an elevation view of the control panel 90 with portion 98 removed is shown. Located within the control panel 90 are output relays 100, input relays 102, terminal connectors 104, signal isolators 106 and a power supply 108. These components will be discussed further below.

Figure 4B:
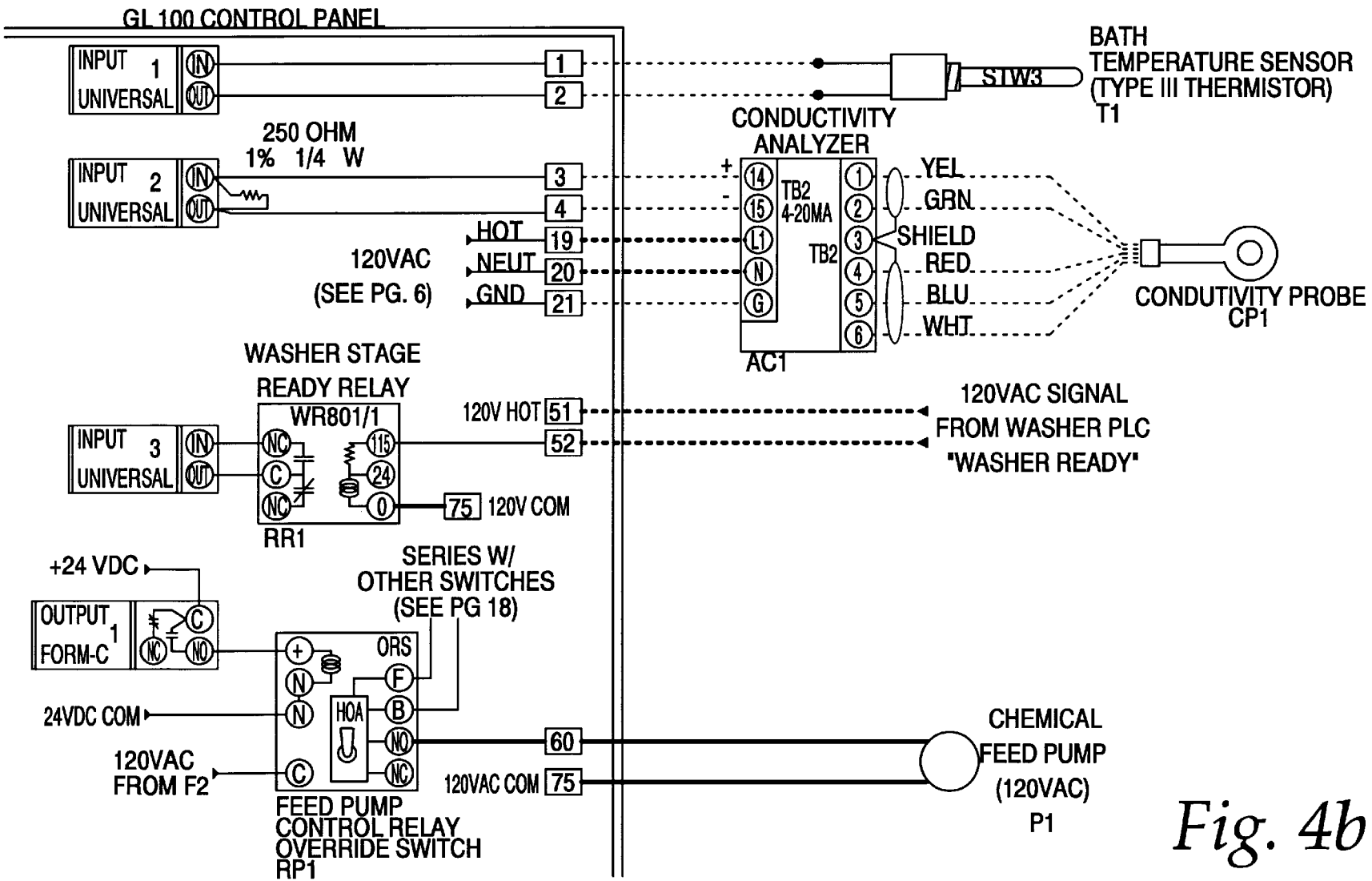
Figure 4C:
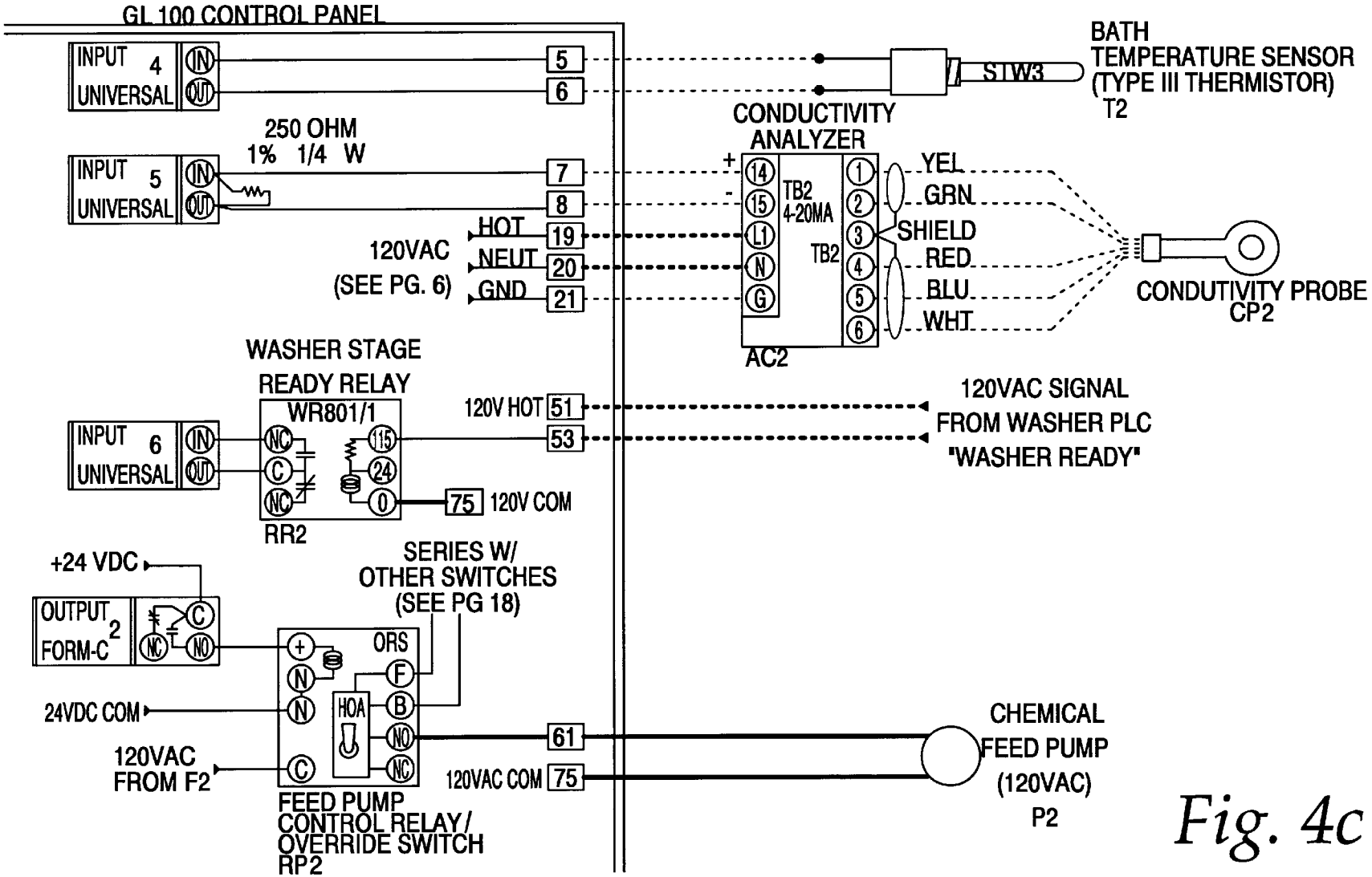
Figure 4D:
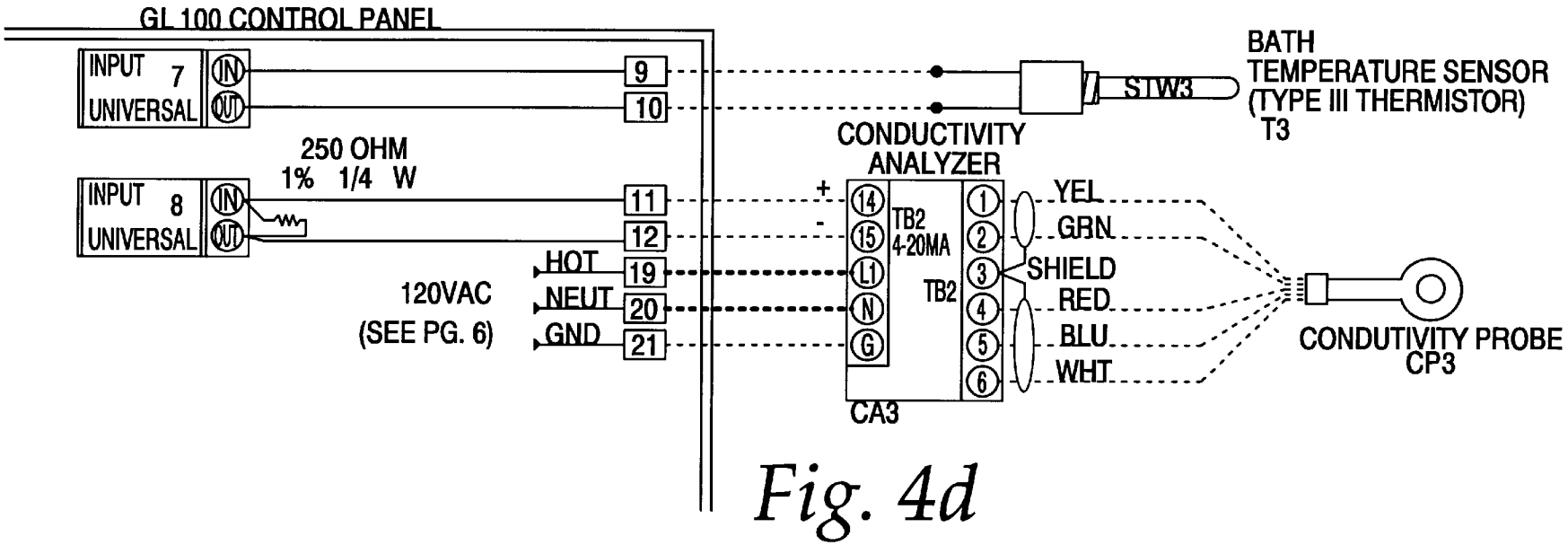
Figure 4E:
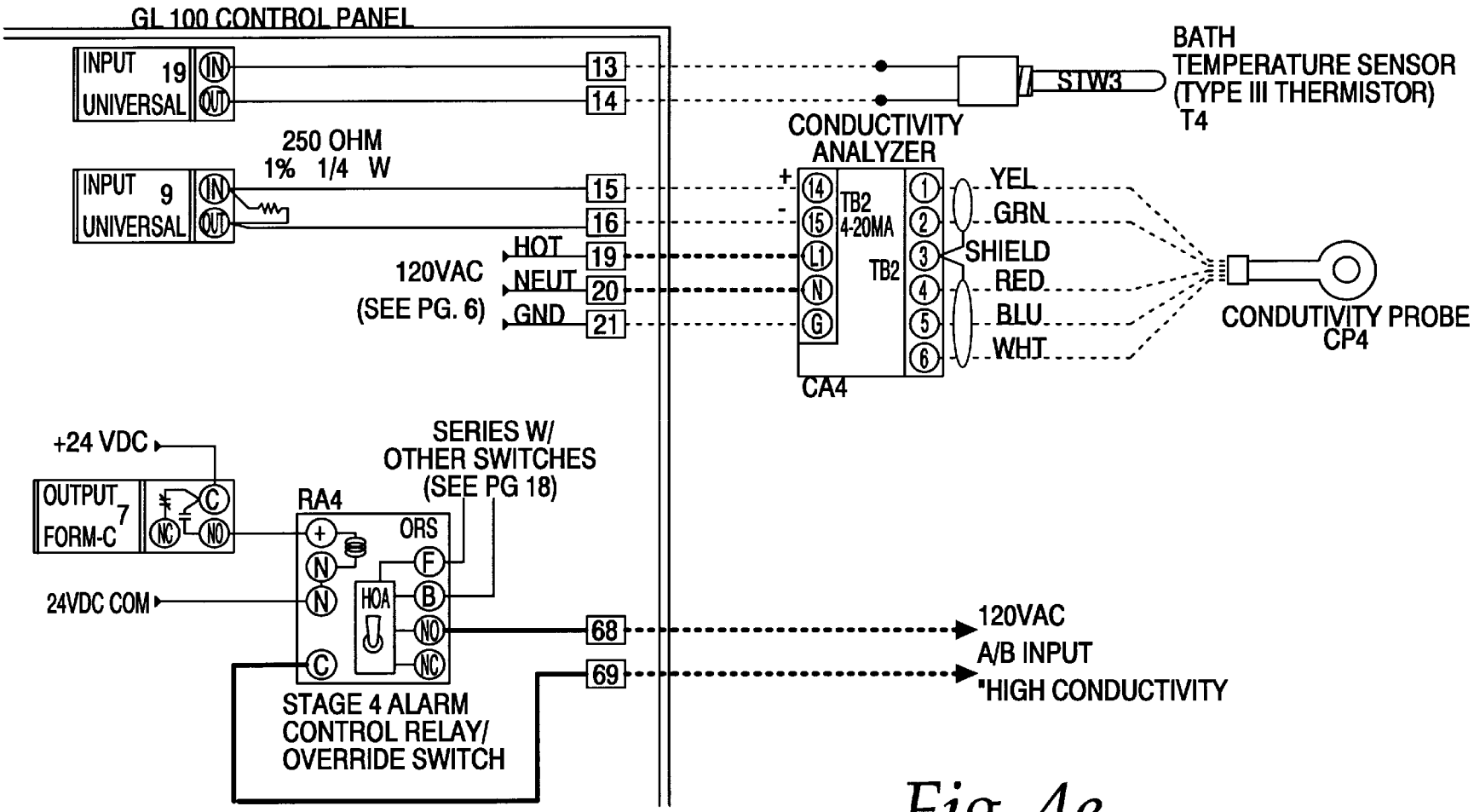
Figure 4F:
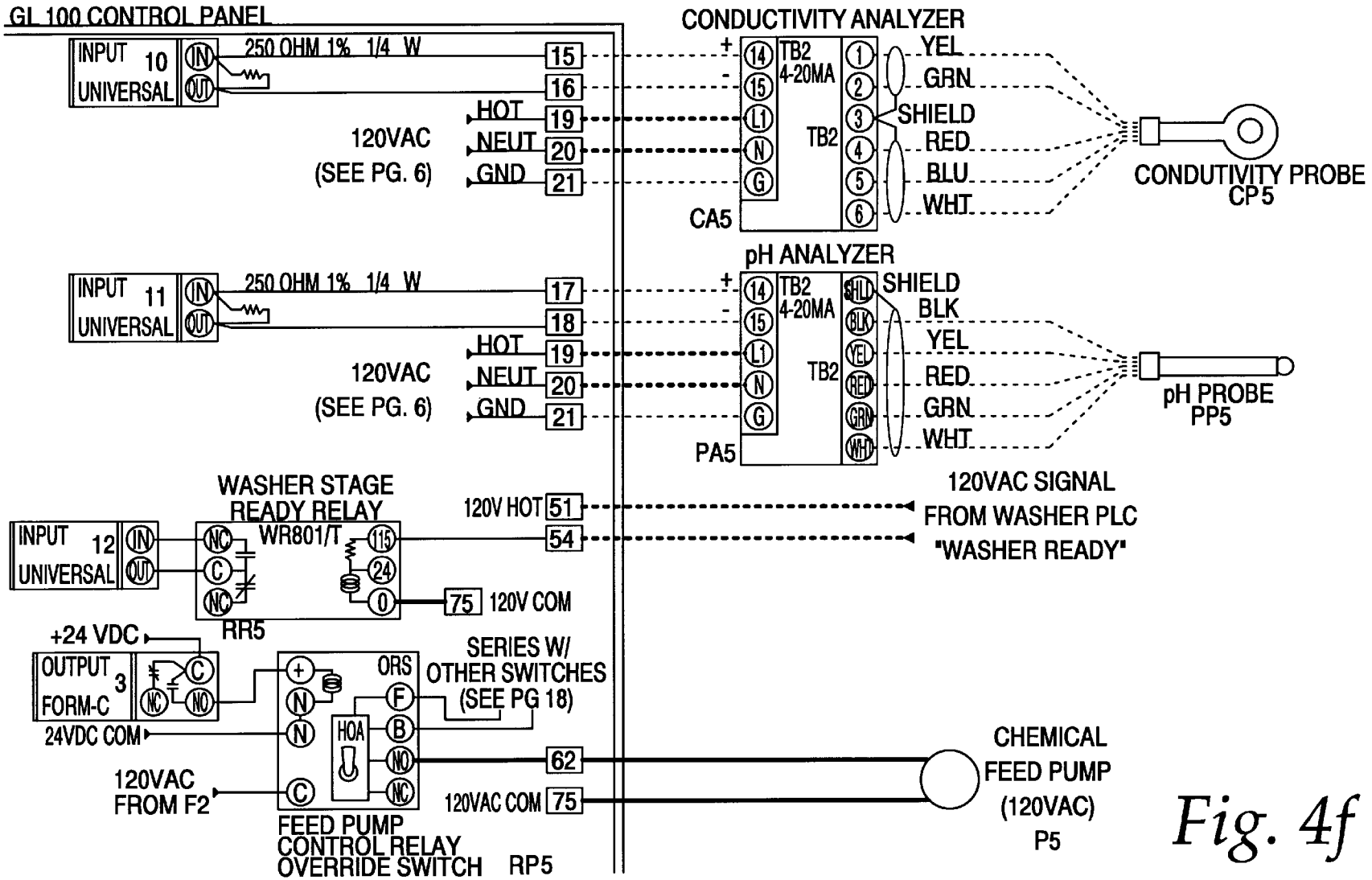
Figure 4G:
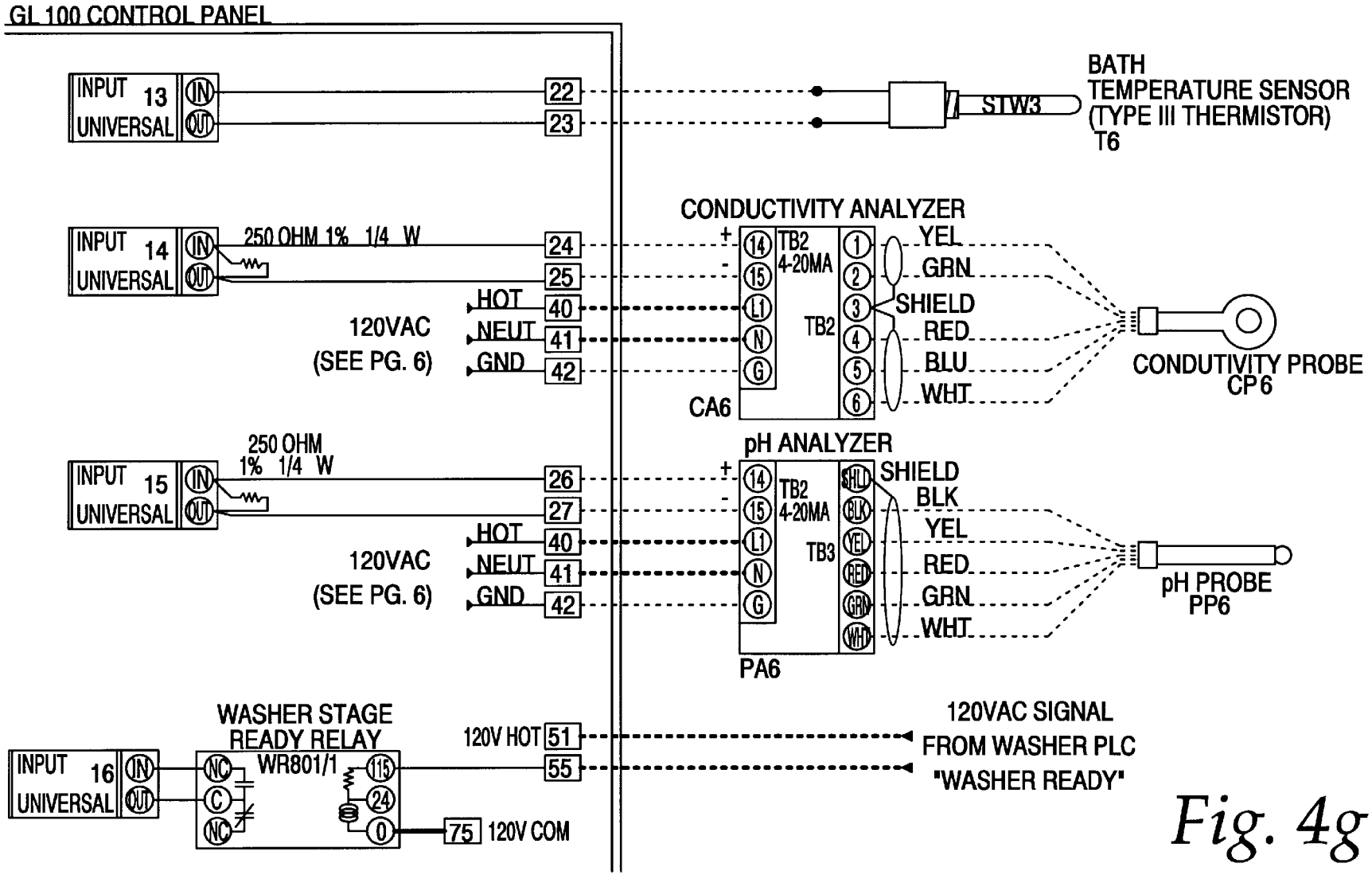
Figures 4H, 4I:
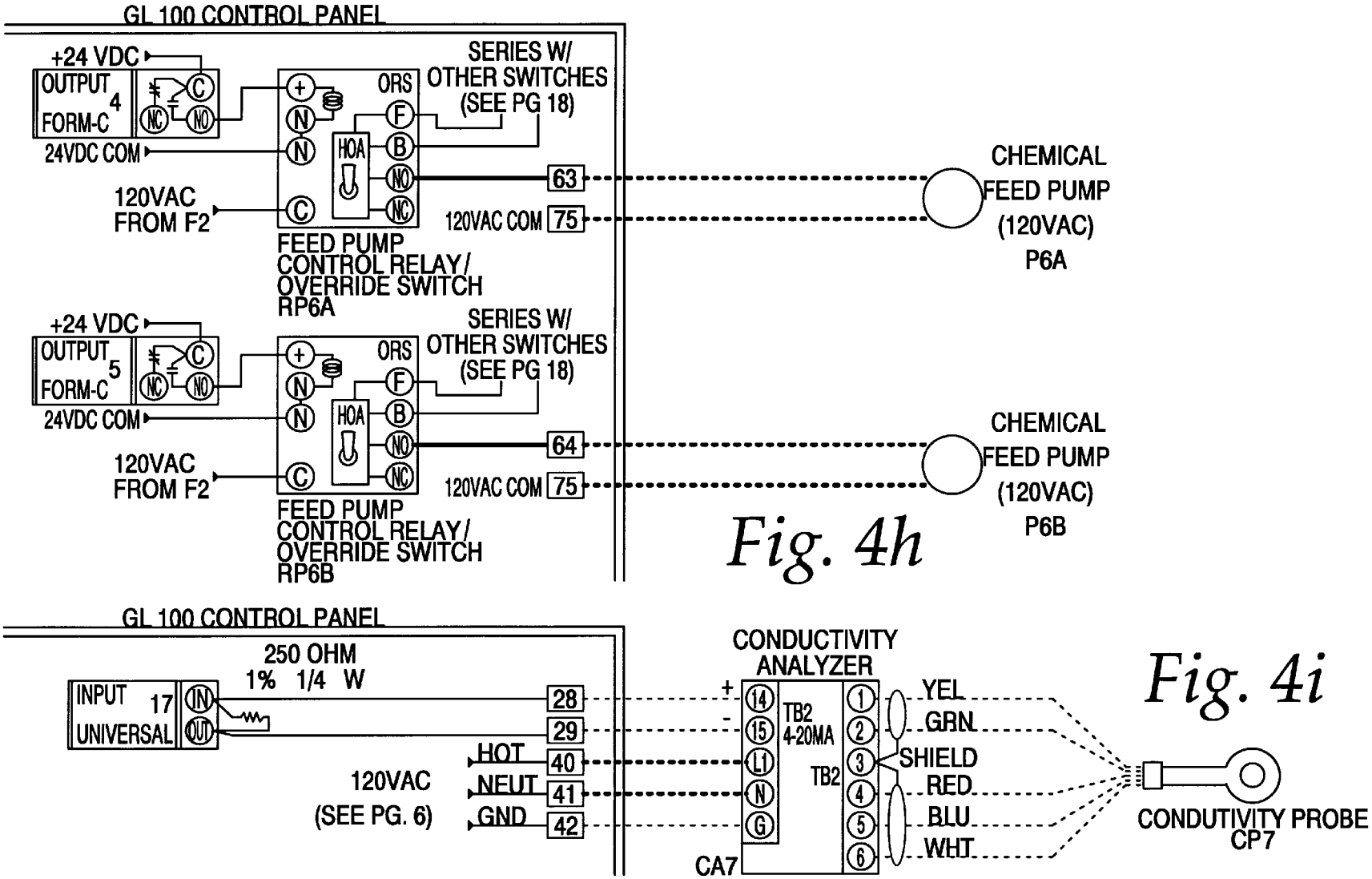
Figure 4J:
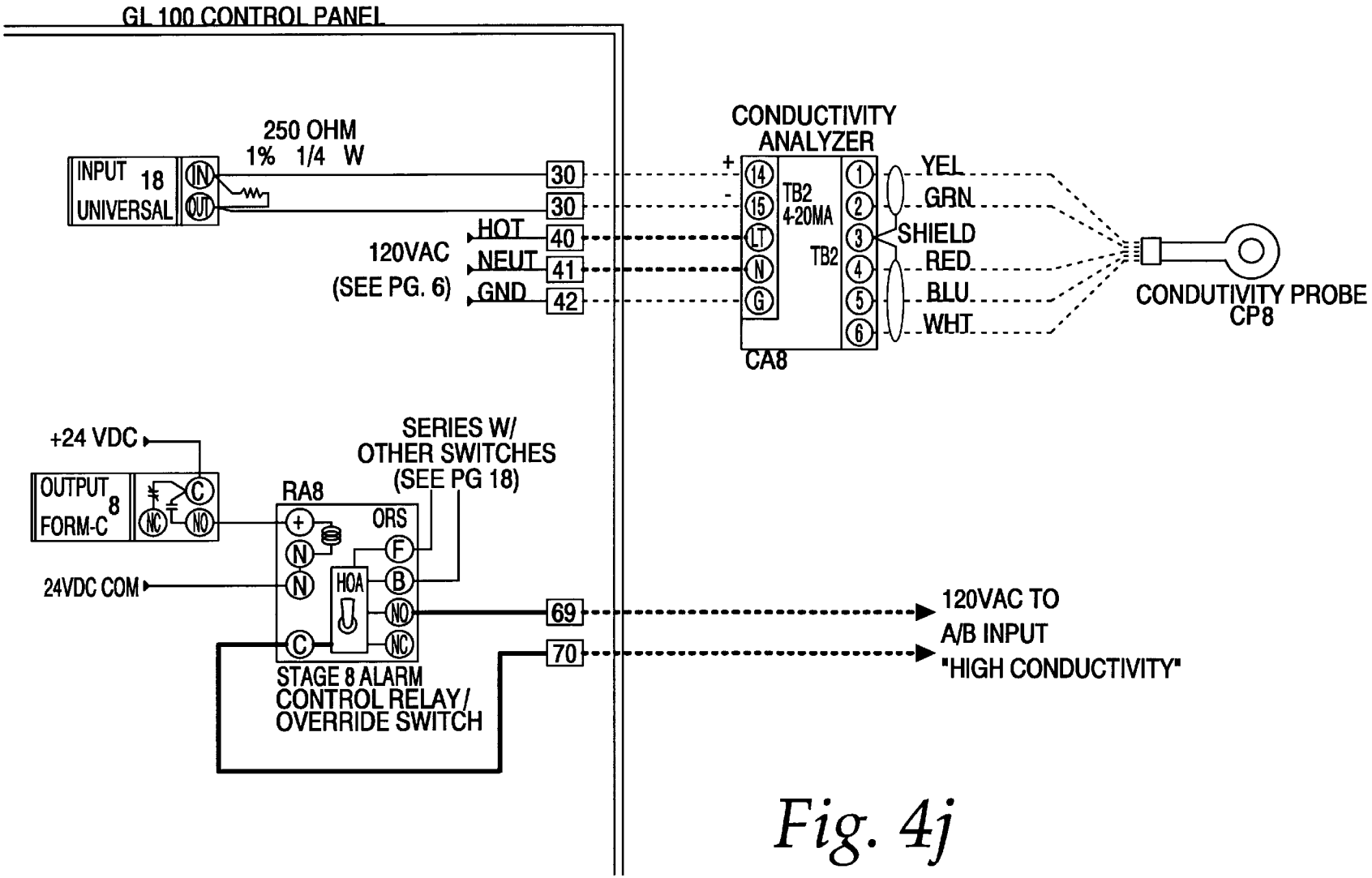
Figure 4K:
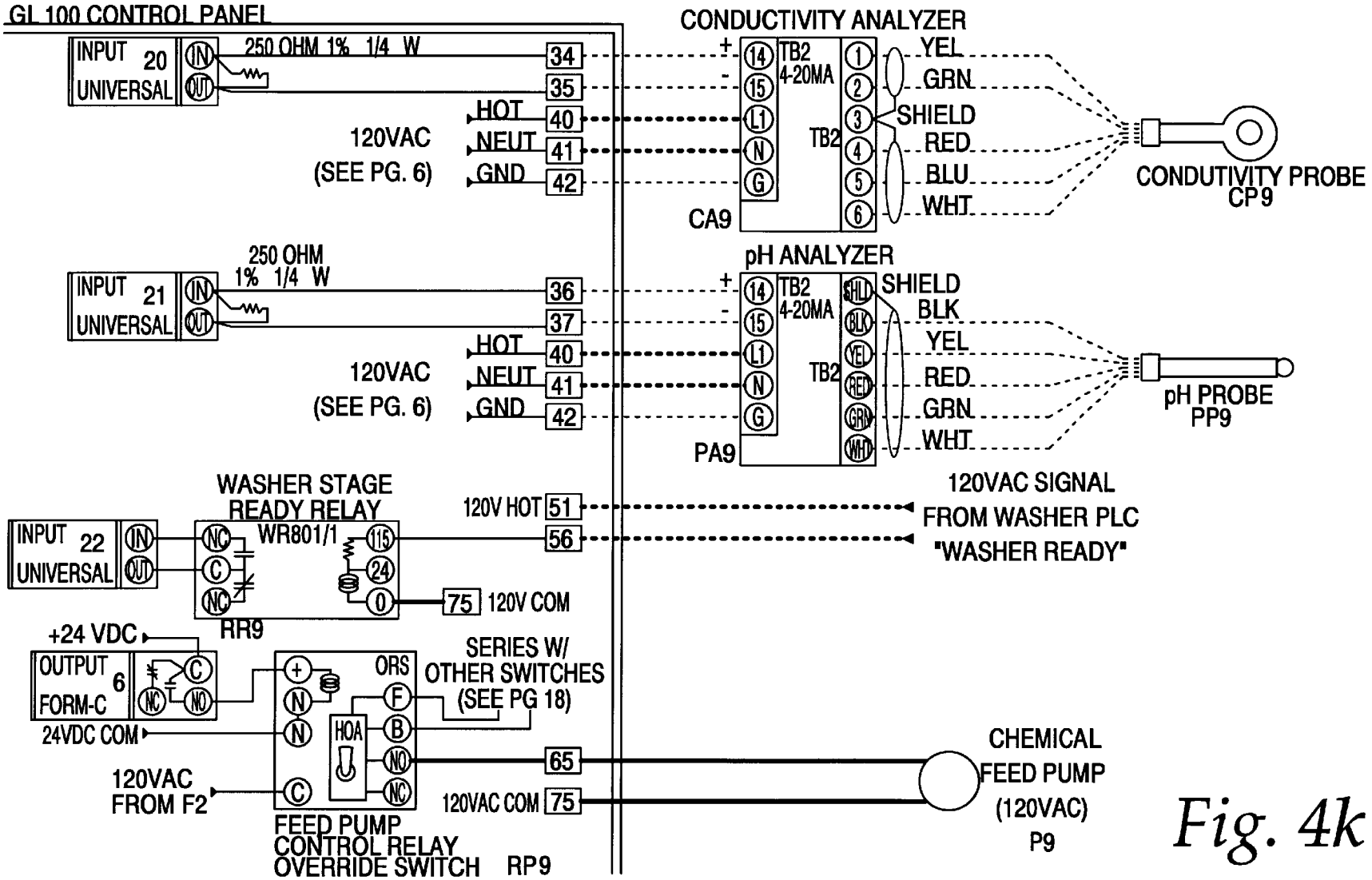
Figure 41:
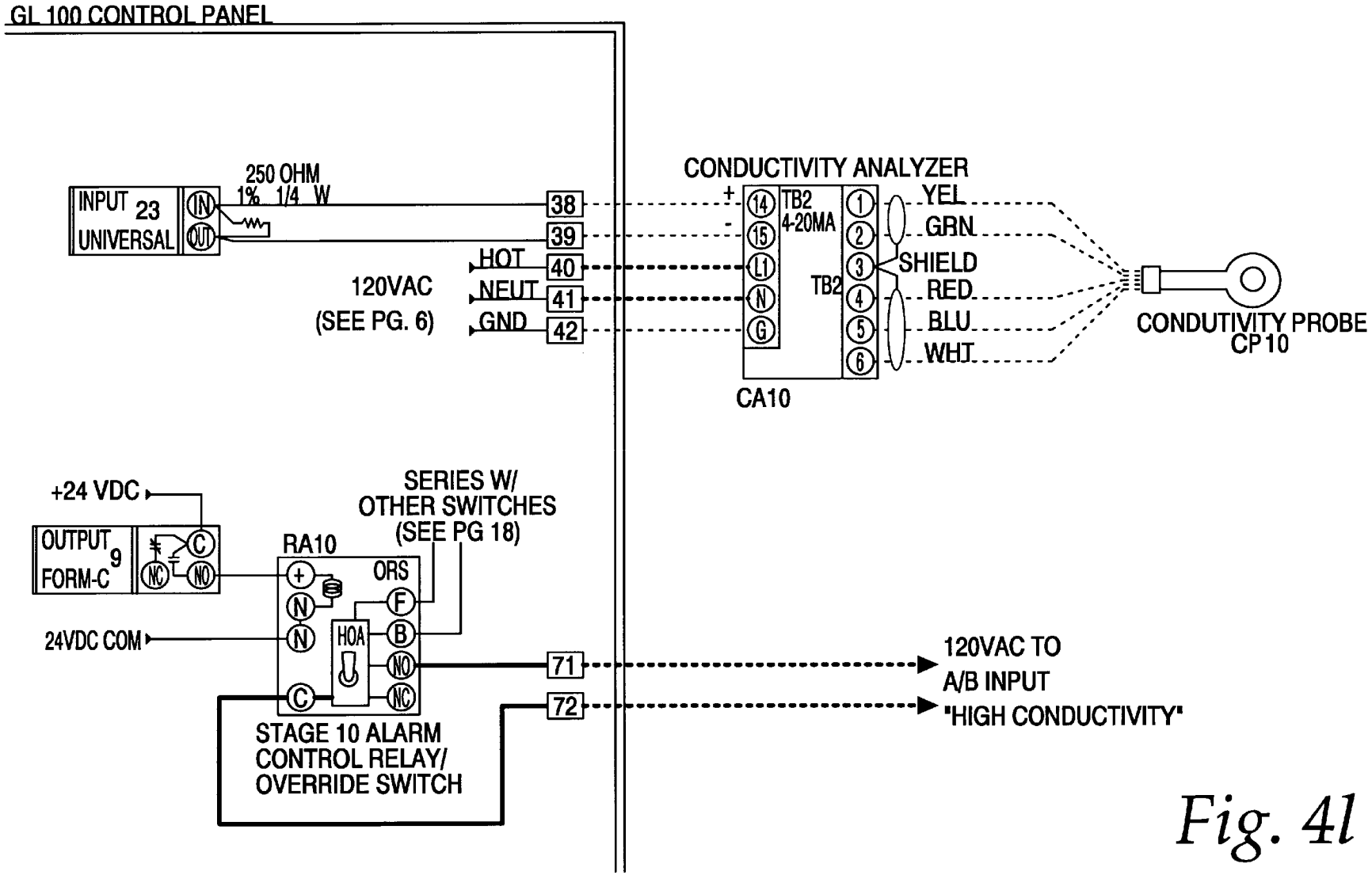
Figure 4M:
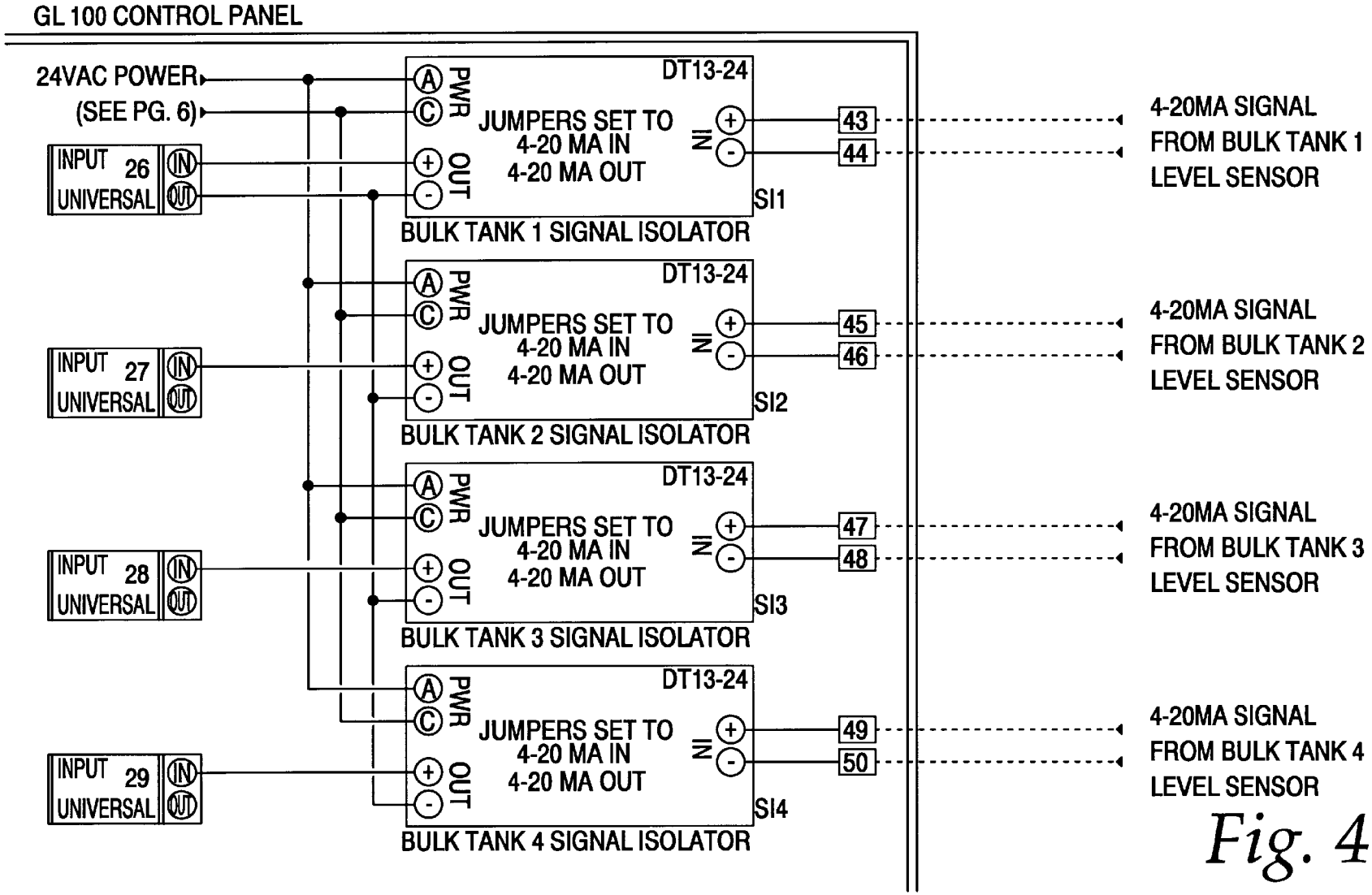
Figure 4N:
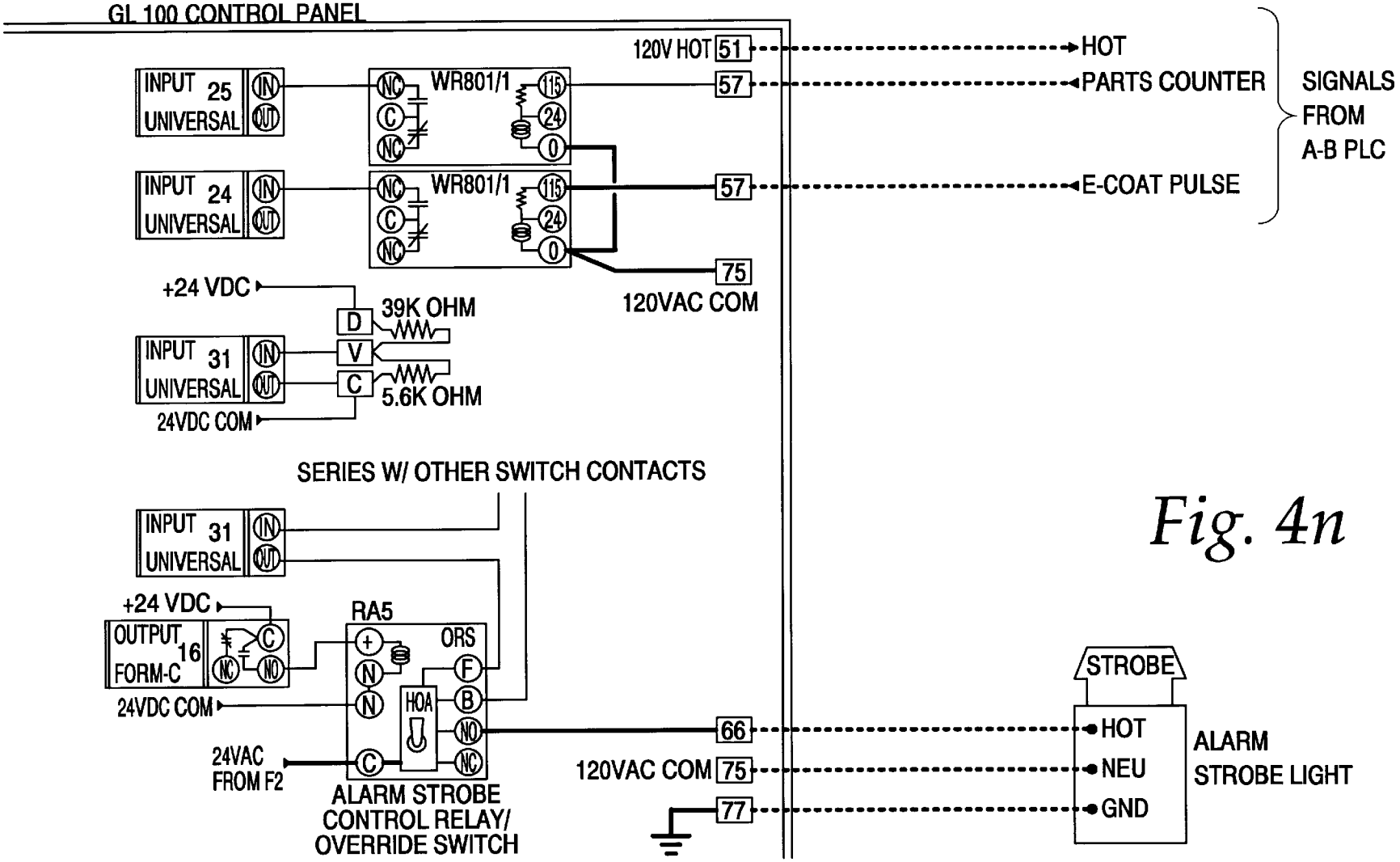

Turning now to FIGS. 4*a–n*, in which partial schematic diagrams of the electronics located within the control panel 90 of FIG. 3 are shown. FIG. 4*a* depicts the power hook-up for the apparatus electronics. FIG. 4*b* depicts the electronics associated with the first stage 24 of FIG. 1. FIG. 4*c* depicts the electronics associated with the second stage 34 of FIG. 1. FIG. 4*d* depicts the electronics associated with the third stage 40 of FIG. 1. FIG. 4*e* depicts the electronics associated with the fourth stage 44 of FIG. 1. FIG. 4*f* depicts the electronics associated with the fifth stage 48 of FIG. 1. FIGS. 4*g* and 4*h* depict the 223 electronics associated with the sixth stage 54 of FIG. 1. FIG. 4*i* depicts the electronics associated with the seventh stage 60 of FIG. 1. FIG. 4*j* depicts the electronics associated with the eighth stage 64 of FIG. 1. FIG. 4*k* depicts the electronics associated with the ninth stage 68 of FIG. 1. FIG. 41 depicts the electronics associated with the tenth stage 74 of FIG. 1. FIG. 4*m* depicts the electronics associated with the bulk tan level inputs of apparatus 10 of FIG. 1. FIG. 4*n* depicts the electronics associated with the miscellaneous control inputs of apparatus 10 of FIG. 1.

Figure 5:
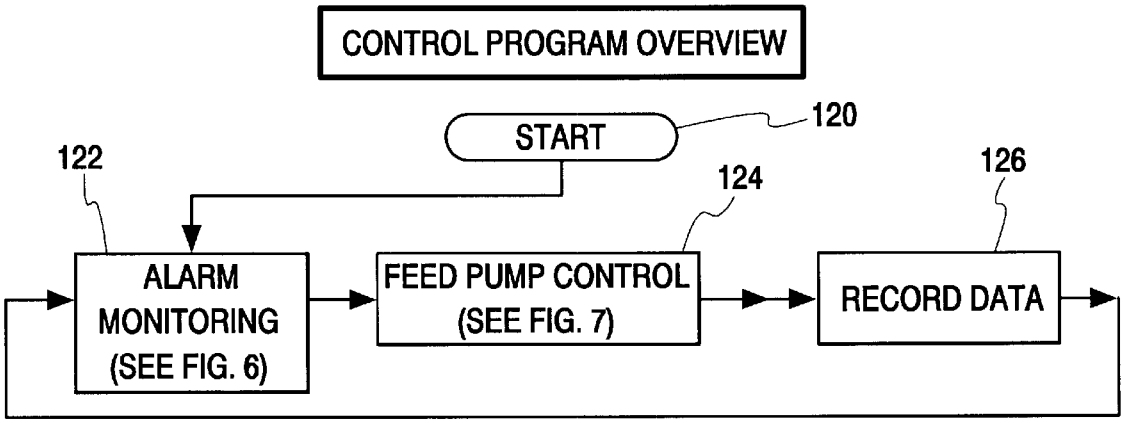
FIG. 5 is a high level flowchart of the control program software operating within the controller of FIG. 1.

Turning now to FIG. 5 in which a high level flowchart of the control program software operating within the controller 12 of FIG. 1 is shown. The program begins at step 120 and monitors the metal treatment process at step 122. If the controller detects from an input that an alarm condition has occurred, it will generate an alarm. If the controller detects that one of the monitored parameters is straying from the setpoint value for that parameter, it may control the feed pumps in step 124 to maintain the parameter within the desired range or restore the parameter to the desired range. Throughout the metal treatment process, and in step 126, the controller records data pertaining to the monitored parameters so that an operator may review the process data and/or print logs, charts, graphs, or tables pertaining to the data collected.

Figure 6:
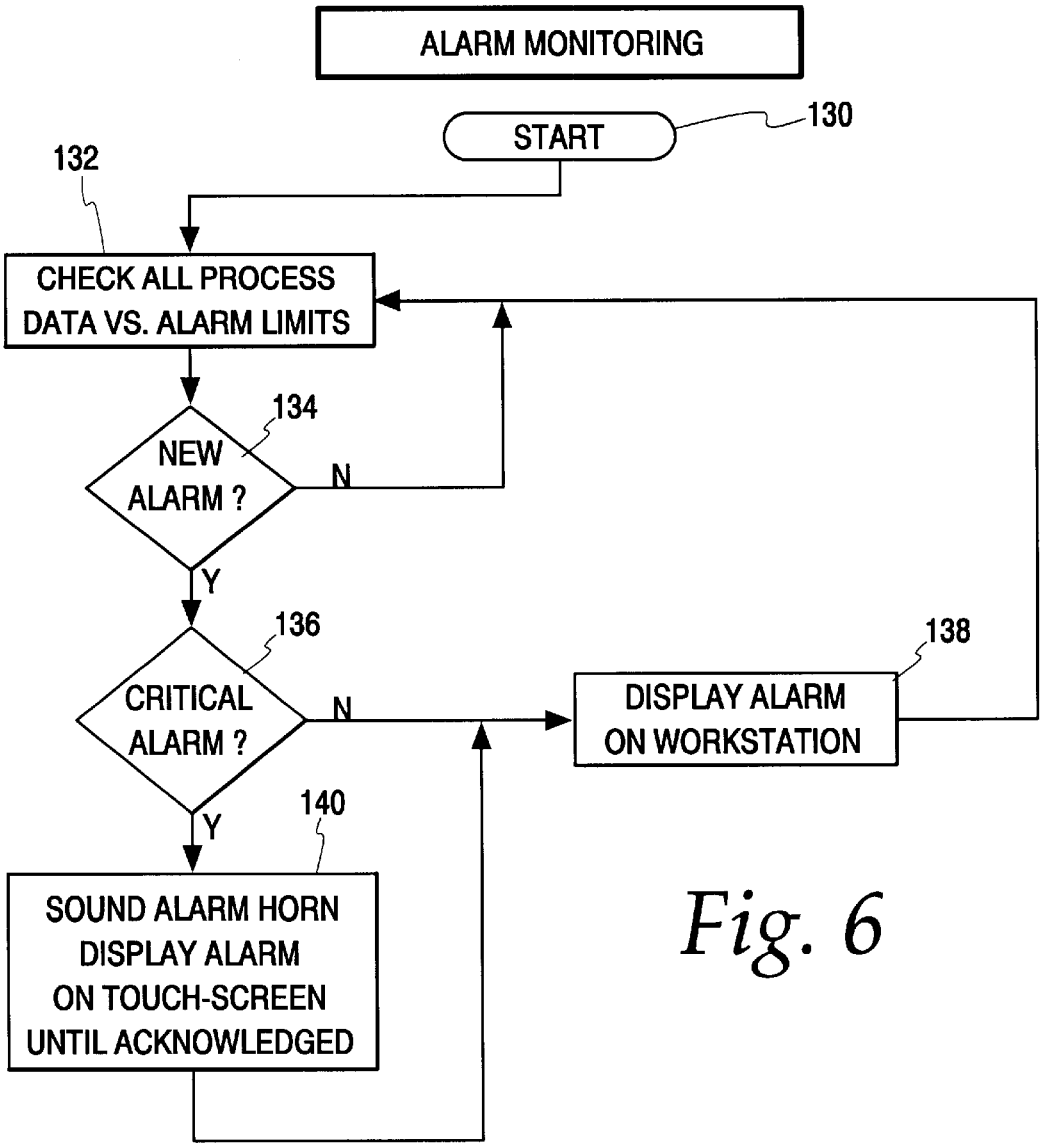
FIG. 6 is a high level flowchart of the alarm monitoring routine covered in FIG. 5 and operating within the controller of FIG. 1.

FIG. 6 is a high level flowchart of the alarm monitoring routine discussed in FIG. 5 and operating within the controller of FIG. 1. The program begins at step 130 and compares the setpoint data stored in the microprocessor to the monitoring sensors in step 132. If the data is not within the desired range the controller recognizes that an alarm should be issued and transfers control to step 134. In step 134, the controller determines whether the alarm condition is a new alarm condition or an old alarm condition. If the alarm condition is old, an alarm message will have already been sent notifying the operators that such a condition has occurred, so control is transferred back to step 132 and the controller continues to monitor the treatment process for new alarm conditions. If the alarm condition is new, control is transferred to step 136 and the controller determines whether the alarm condition is critical or merely minor. If the alarm condition is minor, (e.g., not requiring immediate response), control is transferred to step 138 and an alarm message is displayed on the work station for the operators to see and control is transferred back to step 132. If the alarm condition is critical, (e.g., requiring immediate response), control shifts from step 136 to step 140, an alarm is sounded, and an alarm message is displayed on the touch screen requiring the operators to acknowledge the alarm prior to doing anything else. An alarm message is displayed on the work station in step 138, and control is transferred back to step 132.

Figure 7:
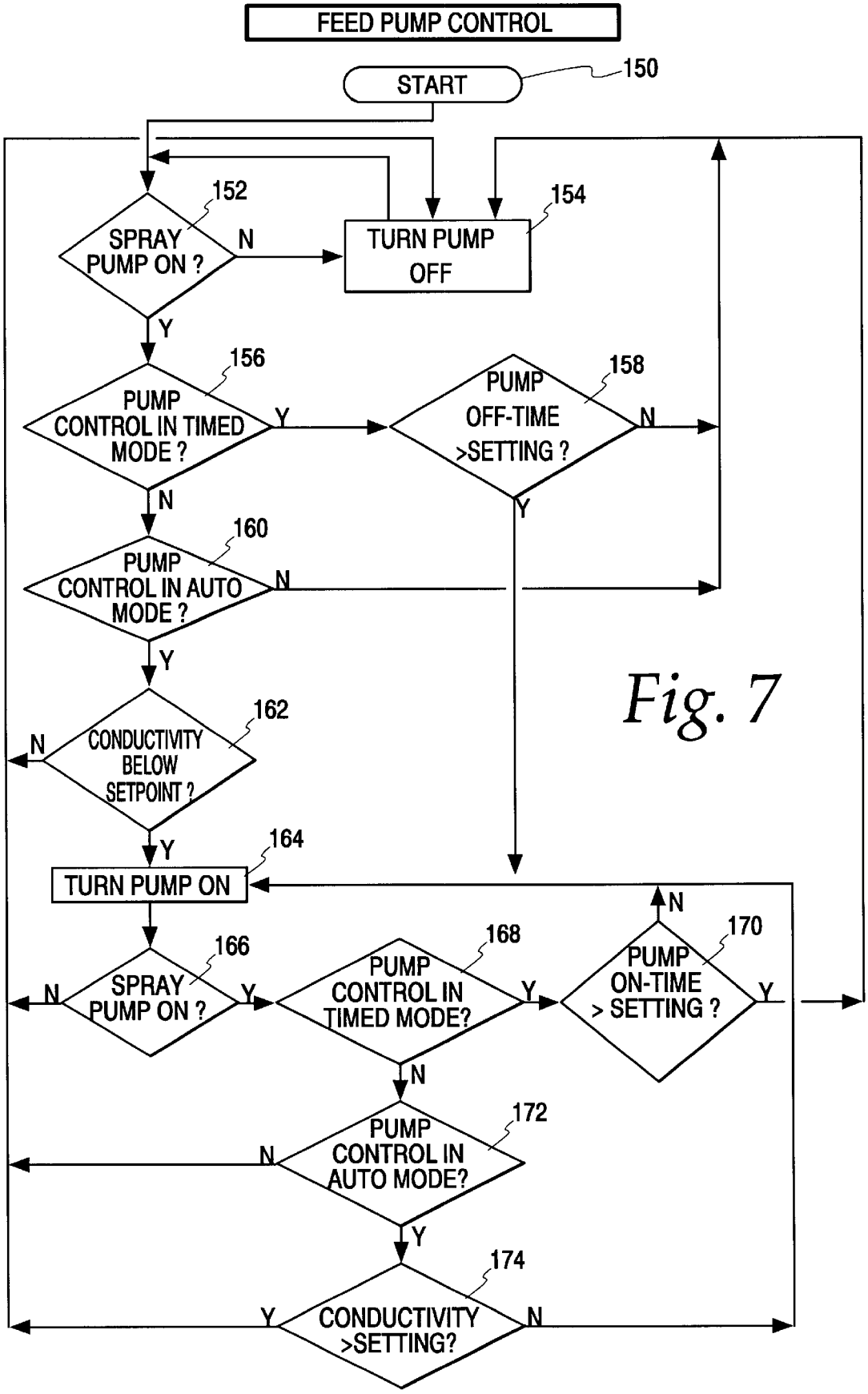
FIG. 7 is a high level flowchart of the feed pump control routine covered in FIG. 5, and operating within the controller of FIG. 1.

FIG. 7 is a high level flowchart of the feed pump control routine discussed in FIG. 5 and operating within the controller of FIG. 1. The program begins at step 150 and the controller checks to see if the spray pump is on in step 152. If the pump is not on, control is transferred to step 154 where the controller is instructed to turn the pump off (or in this case continue to leave the pump off) and then return to step 152. If the pump is on, control is transferred to step 156 where the controller determines if the pump control is in timed mode (rather than auto mode). If the pump is in timed mode, the controller determines whether it is currently a pump on time setting or a pump off time setting in step 158. If it is currently a pump off time setting, the pump is turned off in step 154 and returns to step 152. If it is currently a pump on time setting, the pump is turned on in step 164. If the pump control is not in timed mode control is transferred from step 156 to step 160 and the controller confirms that the pump is set to auto. If the pump control is not in the auto mode the controller determines that the pump control is in the off mode and turns off the pump in step 154 and returns to step 152. If the pump is in the auto mode, the controller checks to see if the solution conductivity value is less than the setpoint conductivity value in step 162. If the solution conductivity is not less than the setpoint conductivity, the pump is turned off (or remains off) in step 154 and control returns to step 152. If the solution conductivity is less than the setpoint conductivity, the pump is turned on in step 164 and the controller checks to see if the spray pump is on in step 166. If the spray pump is not on, the pump is turned off in step 154 and control returns to step 152. If the spray pump is on, control is transferred to step 168 and the controller checks to see whether the pump control is still in the auto mode or if it has been switched to the timed mode. If the pump control is in the timed mode, control is transferred to step 170 and the controller determines whether it is currently a pump on time or a pump off time. If it is a pump on time, control is transferred to step 164 and the pump is turned on (or remains on). If it is a pump off time, the pump is turned off in step 154 and control is returned to step 152. If the pump control is not in the timed mode, control is transferred to step 172 and the controller determines whether the pump is in auto mode or off mode. If the pump is not in auto mode, (meaning it must be in off mode), the pump is turned off in step 154 and control is returned to step 152. If the pump is in auto mode, control is transferred to step 174 and the controller determines whether the conductivity of the solution has been raised to the point that it is greater than the setpoint conductivity. If the solution conductivity is greater than the setpoint conductivity, the pump is turned off in step 154 and control is returned to step 152. If the solution conductivity is not greater than the setpoint conductivity, control transfers to step 164 and the pump is turned on (or remains on).

Figure 8:
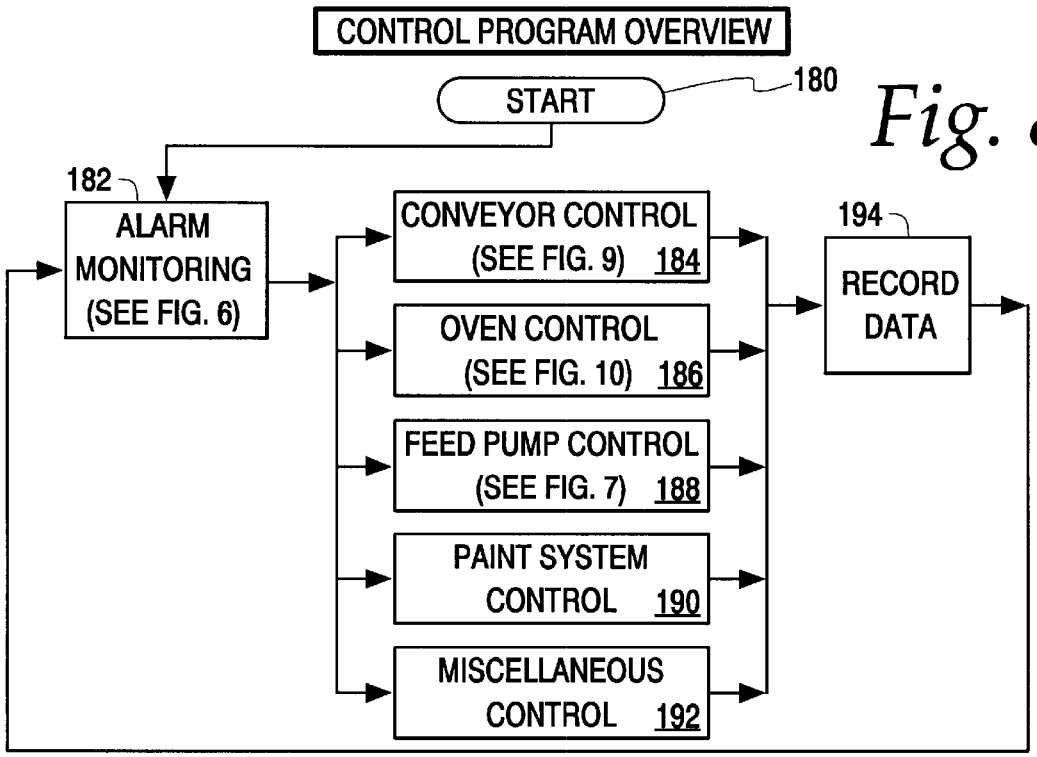
FIG. 8 is a lower level flowchart of the control program overview routine covered in FIG. 5, and operating within the controller of FIG. 1.

Turning now to FIG. 8, in which a lower level flowchart of the control program overview routine discussed in FIG. 5 and operating within the controller of FIG. 1 is shown. The program begins at step 182 and monitors the metal treatment process at step 182. A discussion of this monitoring is set forth above and in FIG. 6. Based on the input received from the controllers monitoring of the treatment process, the program may branch to a subroutine for controlling a conveyor (step 184), an oven (step 186), a feed pump (step 188), a paint system (step 190), or other miscellaneous matter (step 192). A more detailed description of some of these subroutines follows. In addition to controlling all of the various functions, the system records data in step 194 to allow operators to review or retrieve information about the treatment process and print or maintain logs, graphs, charts, etc. corresponding to the data accumulated.

Figure 9:
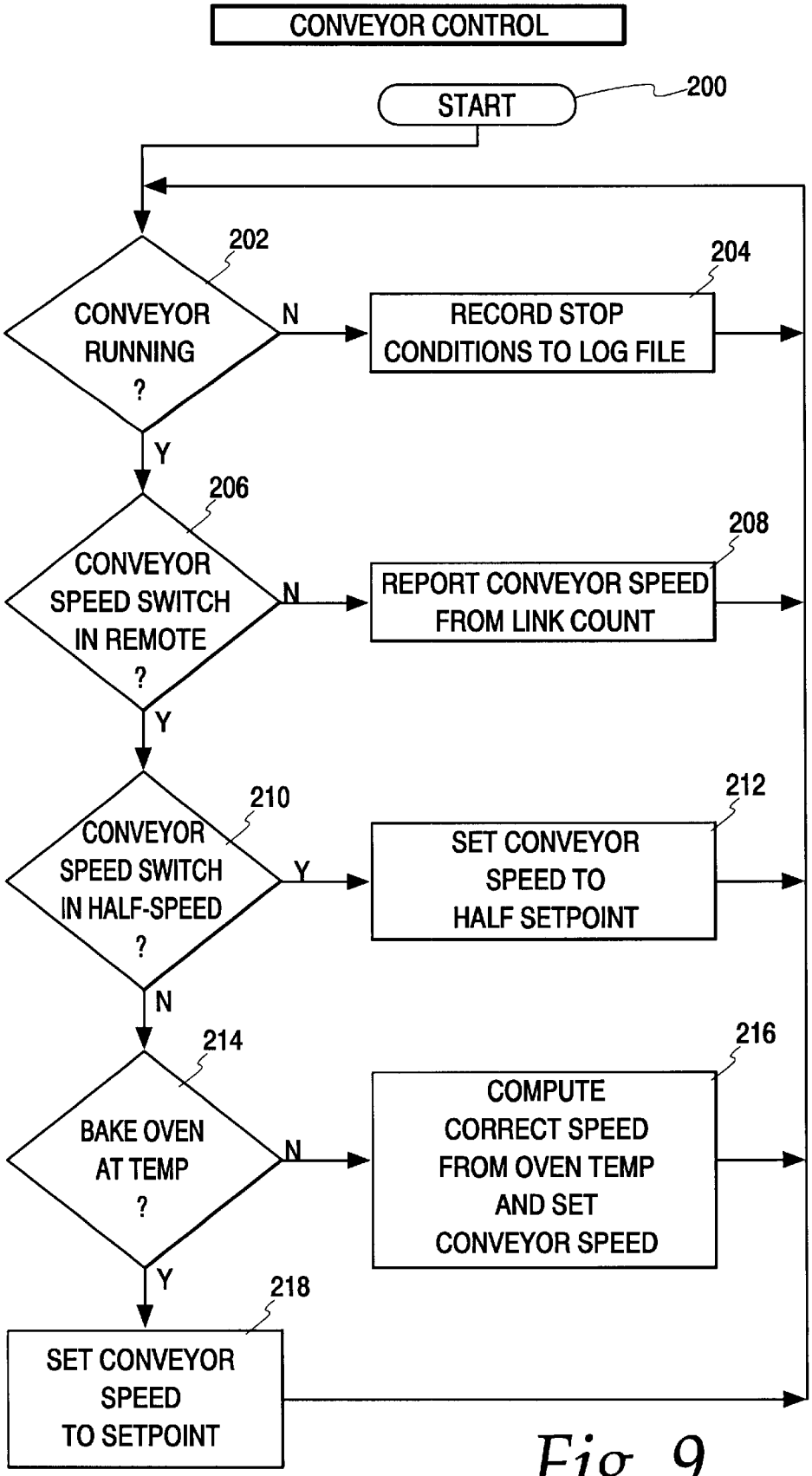
FIG. 9 is a flowchart of the conveyor control routine covered in FIG. 8 and operating within the controller of FIG. 1.

FIG. 9 is a flowchart of the conveyor control routine discussed in FIG. 8 and operating within the controller of FIG. 1. The program begins at step 200 and the controller checks to see if the conveyor is running in step 202. If the conveyor is not running, the controller will record the stop conditions, (e.g., why the conveyor stopped), in a log (step 204) and will return control to step 202. If the conveyor is on, control transfers to step 206 and the controller determines whether the conveyor speed switch has been set. If it has not, the controller will report the conveyor speed based on its count of the conveyor links in step 208 and will return control to step 202. If the conveyor speed switch has been set, the controller will determine whether half-speed has been selected in step 210. If half-speed has been selected, the controller will set the conveyer to half the speed indicated as the setpoint speed, (e.g., half setpoint speed) in step 212 and will return control to step 202. If half-speed has not been selected, the controller checks to see if the bake oven is at temperature in step 214. If the oven is not at temperature, the controller calculates the correct conveyor speed according to the current oven temperature and sets the conveyor to that speed in step 216. Once the conveyor speed has been set, control returns back to step 202. If the oven is at temperature, the controller sets the conveyor speed to the setpoint speed in step 218 and returns control back to step 202.

Figure 10:
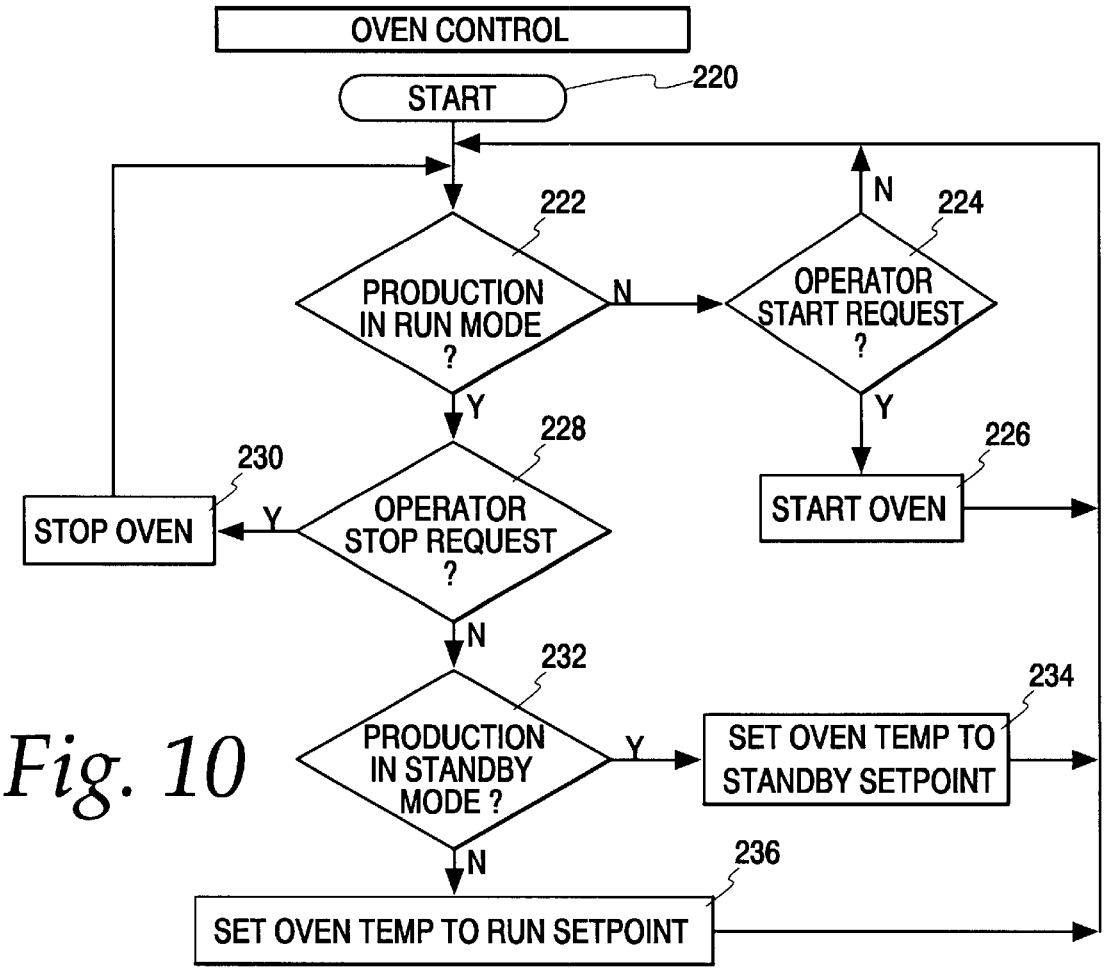
FIG. 10 is a flowchart of the oven control routine covered in FIG. 8 and operating within the controller of FIG. 1.

FIG. 10 is a flowchart of the oven control routine discussed in FIG. 8 and operating within the controller of FIG. 1. The program begins at step 220 and the controller checks to see if the oven is in production run mode in step 202. If the oven is not in run mode, the controller checks to see if an operator has requested oven start in step 224. If an operator has requested the oven to start, the oven is started in 226 and control returns to step 222. If the oven is in run mode, the controller checks to see if an operator has made a stop request in step 228. If the operator has requested a stop, the oven is stopped in step 230 and control is returned to step 222. If the operator has not requested a stop, the controller checks to see if the oven is in production standby mode in step 232. If the oven is in standby mode, the oven temperature is set to the standby setpoint temperature in step 234 and control is returned to step 222. If the oven is not in standby mode, the oven temperature is set to the run setpoint temperature in step 236 and control is returned to step 222.

Figure 11:
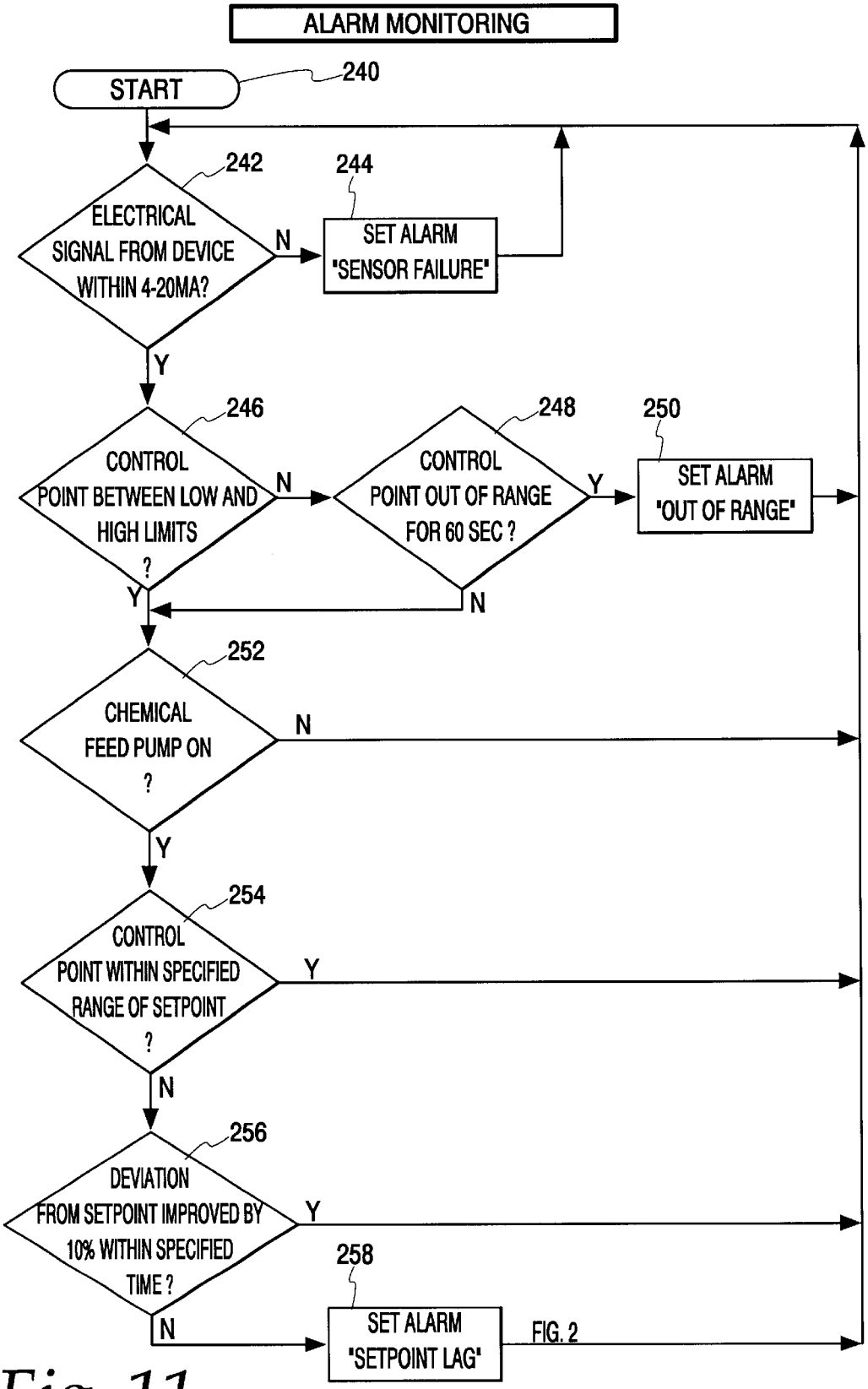
FIG. 11 is a flowchart of another alarm monitoring routine capable of operating within the controller of FIG. 1.

FIG. 11 is a flowchart of another alarm monitoring routine capable of operating within the controller of FIG. 1. The program begins at step 240 and the controller checks to see if the alarm monitoring signal from the input sensor is within the proper amperage in step 242. If the alarm monitoring signal is not within the proper amperage, a sensor failure alarm is set in step 244 and control returns to step 242. If the alarm monitoring signal is within the proper amperage, the controller checks to see if the control point (or monitored parameter) value is between the upper and lower limits of the setpoint value in step 246. If the control point is not within these limits, the controller checks to see if the control point has been outside of the setpoint range for sixty seconds or more in step 248. If the control point has been out of specification for sixty seconds or more, the controller sets an out of range alarm in step 250 and returns control to step 242. If the control point is between the upper and lower limits of the setpoint, or if the control point has not been out of the upper and lower limits of the setpoint for sixty seconds or more, the controller checks to see if the chemical feed pump is on in step 252. If the pump is not on, control returns to step 242. If the pump is on, the controller checks to see if the control point is within a specified range of setpoints in step 254. If the control point is within this range of setpoints, control is returned to step 242. If the control point is not within this range of setpoints, the controller checks to see if the amount the control point deviates from the setpoint improves (or is reduced) by ten percent within a predetermined amount of time in step 256. If the deviation from the set point improves by ten percent within the specified time frame, control is returned to step 242. If the deviation from the set point does not improve by ten percent within the specified time frame, the controller sets a setpoint lag alarm in step 258 and returns control to step 242.

Figure 12:
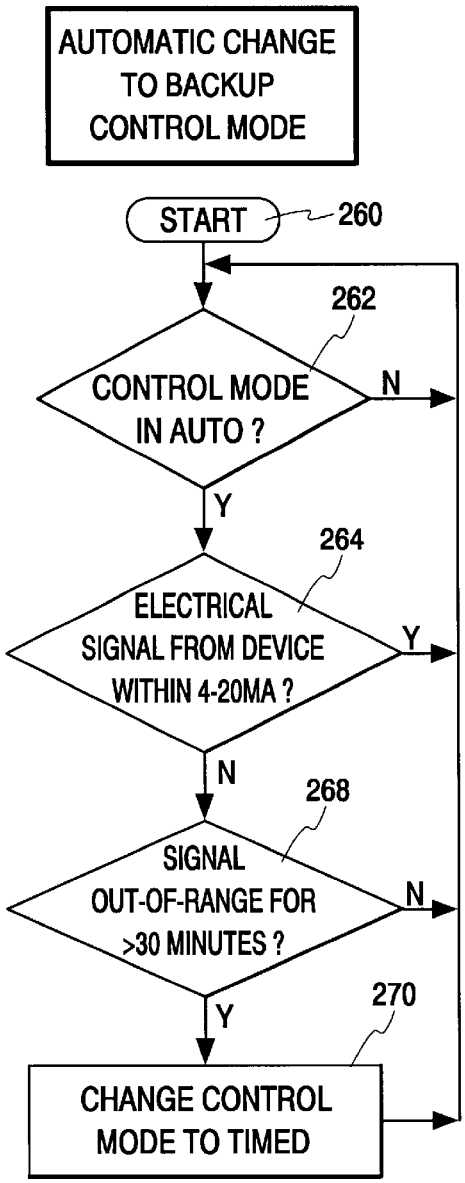
FIG. 12 is a flowchart of a routine for automatically changing the control mode from auto to timed in cases where a sensor failure has occurred.

FIG. 12 is a flowchart of a routine for automatically changing the control mode from auto to timed in cases where a sensor failure has occurred. The program begins at step 260 and the controller checks the control mode to see if auto has been selected in step 262. If auto has not been selected, the program routine continues to loop until the control mode has been set to auto. If auto has been selected, the controller checks the amperage of the electrical signal from the sensor in step 264 to determine whether or not the sensor is working properly. If the amperage of the signal is within the specified range, control is returned to step 262. If the amperage of the signal is not within the specified range, the controller checks to see if the signal amperage has been out of range for more than thirty minutes in step 268. If the signal has not been out of range for more than thirty minutes, control is returned to step 262. If the signal has been out of range for more than thirty minutes, the controller changes the control mode from the auto mode to the timed mode in step 270 and returns control to step 262.

Figure 13:
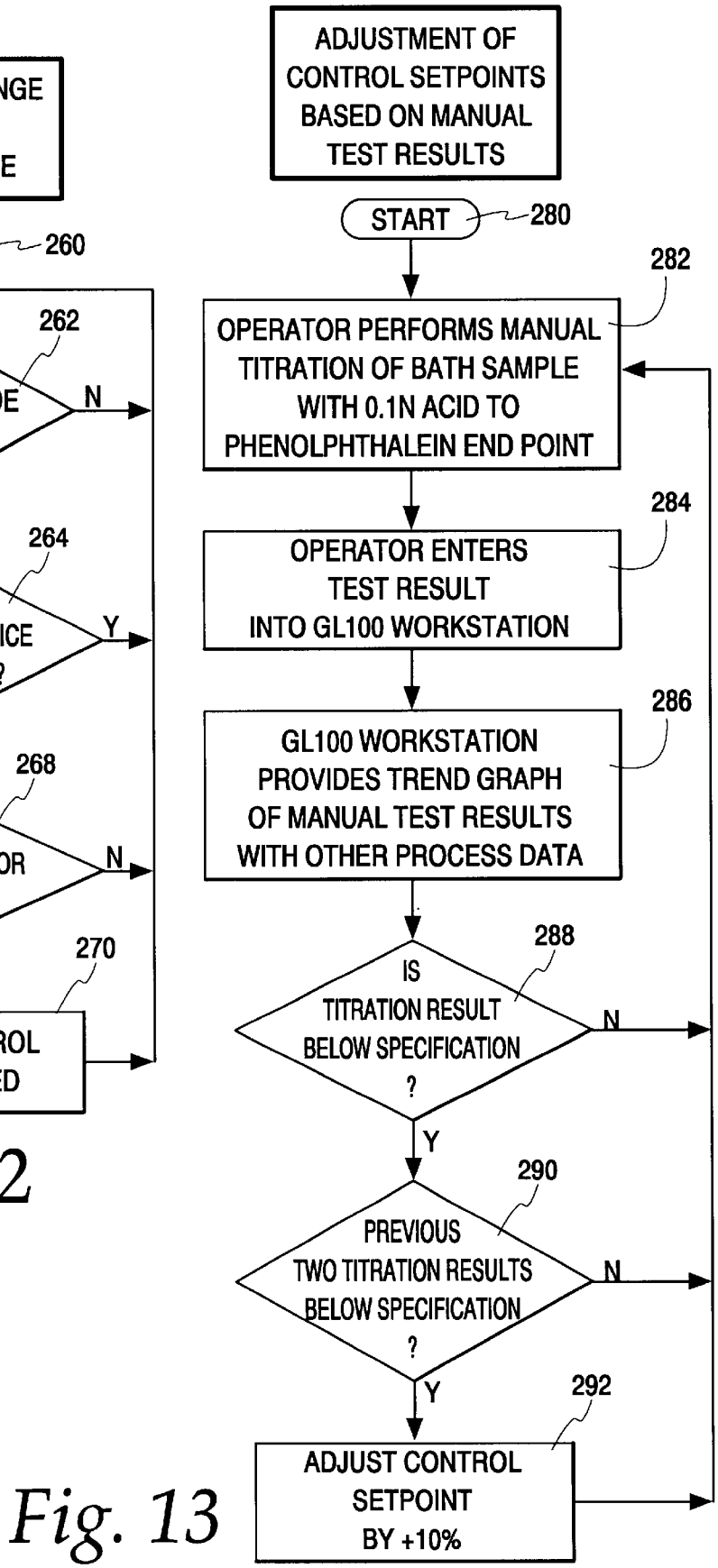
FIG. 13 is a flowchart of a routine for adjusting control setpoints based on manual test results.

FIG. 13 is a flowchart of a routine for adjusting control setpoints based on manual test results. The program begins at step 280 and the operator performs manual titration of a bath sample with a 0.1N acid to phenolphthalein end point in step 282. The operator then enters the test results into a workstation connected to the apparatus 10 for controlling treatment of metal in step 284. The workstation provides trend graphs of the manual test results along with other process data in step 286. The operator (or controller) then determines whether the titration result is below specification (or setpoint) in step 288. If it is not below specification, control returns to step 282. If it is below specification, the operator determines whether the previous two titration results were below specification in step 290. If the previous two titrations were not below specification, control returns to step 282. If the previous two titrations were below specification, the control setpoint is adjusted by ten percent in step 292 and control returns to step 282.

Figure 14:
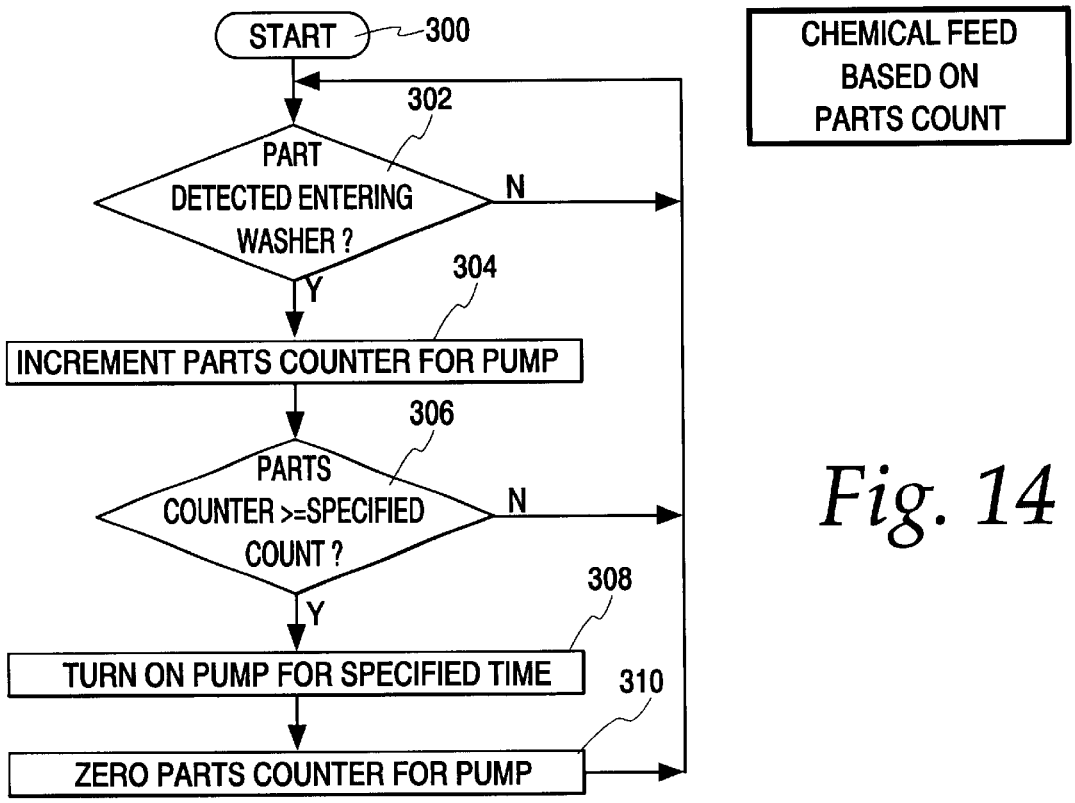
FIG. 14 is a flowchart of a routine for adjusting chemical feed based on a number of parts count.

FIG. 14 is a flowchart of a routine for adjusting chemical feed based on a number of parts count. The program begins at step 300 and the controller determines whether a part has been detected entering a washer stage in step 302. If no part has been detected, control continues to loop until a part is detected. If (or when) a part has been detected, the controller increments a part counter associated with a pump in step 304. The controller then determines whether the parts counter is equal to or greater than a specified count in step 306. If the parts counter is not greater than the specified count, control is returned to step 302. If the parts counter is greater than the specified count, the associated pump is turned on for a specified amount of time in step 308. The controller then zeros the parts counter for the associated pump and returns control to step 302.

Figure 15:
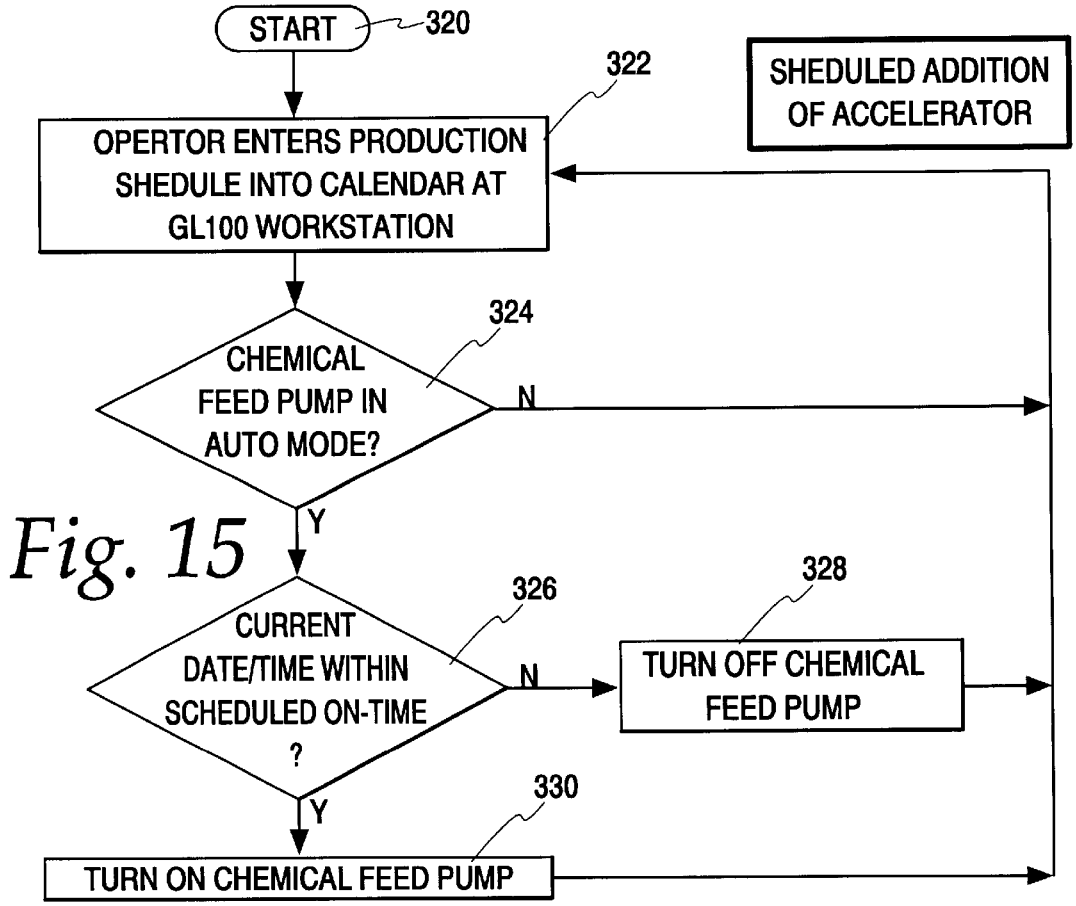
FIG. 15 is a flowchart of a routine for scheduling an addition of accelerator.

FIG. 15 is a flowchart of a routine for scheduling an addition of accelerator. The program begins at step 320 and the operator enters a production schedule into a calendar program at a workstation connected to the apparatus 10 in step 322. The controller determines whether the chemical feed pump is set to the auto mode in step 324. If auto mode is not set, control returns to step 322. If auto mode is set, the controller checks the current date and time to see if they are within the scheduled on-time in step 326. If the date and time are not within the scheduled on-time, the controller turns off the chemical feed pump in step 328 and returns control to step 322. If the date and time are within the scheduled on-time, the controller turns on the chemical feed pump in step 330 and returns control to step 322.

Figure 16:
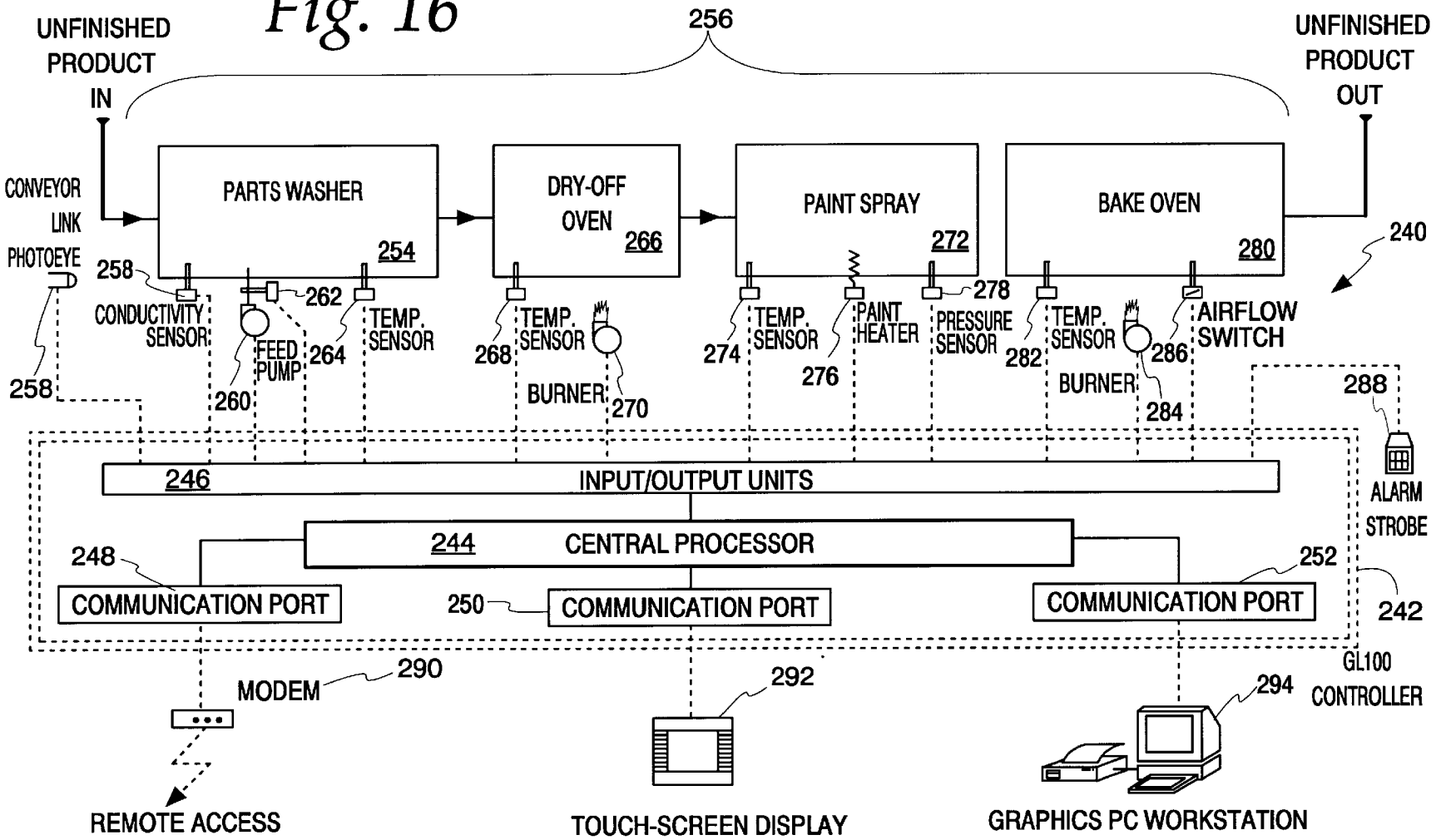
FIG. 16 is a block diagram of an apparatus for controlling treatment of metal according to the invention.

Turning now to FIG. 16, in which an apparatus for controlling treatment of metal is generally shown at reference numeral 240 and includes a controller 242 comprising a central processor unit (CPU) 244, input/output units 246, and communications ports 248, 250 and 252. Unfinished products, (e.g., pretreatment metal workpieces), are attached to a transportation system (not shown), such as a conveyor, and delivered to the parts washer 254 of a multi-staged metal treatment process 256. The apparatus 240 is equipped with an optical sensor 258 to monitor the transportation system for parts and/or speed. The parts washer 254 is a cleansing stage in which the workpiece or unfinished product is cleansed. During this stage, conductivity sensors 258 monitor the conductivity of the bath or cleaner solution. The conductivity is used during this stage to control the cleaner solution concentration, monitor contamination, and control the concentration of zinc phosphate. This stage is also equipped with a feed pump 260 with which the controller 242 can add solutions or chemicals to the bath in order to assist the apparatus in maintaining desired setpoints. The feed pump 260 can be selected to operate in either auto, timed, or off mode. The parts washer 254 also comprises a pressure sensor 262 and temperature sensor 264. These sensors assist the controller in monitoring and controlling the pressure and temperature of the washing system.

The workpiece is then transported to a dry-off oven 266 of the multi-staged metal treatment process 256. The dry-off oven 266 is a drying stage in which the workpiece is dried. During this stage, temperature sensor 268 monitors the temperature of the oven. The temperature sensor 268 is used during this stage to assist the controller 242 in controlling monitoring the oven to ensure that it performs within desired parameters. This stage is also equipped with a burner 270 with which the controller 242 can increase the temperature of the oven when the temperature sensor 268 indicates that such is required.

The workpiece next moves to a paint spray stage 272 of the multi-staged metal treatment process 256. During the paint spray stage 272 the workpiece (now washed and dried) receives at least one coat of paint. Temperature sensor 274 monitors the temperature of the paint, and paint heater 276 allows the controller 242 to heat the paint when the paint temperature sensor indicates that the paint is falling below a specified paint temperature. A pressure sensor 278 also is present and allows the controller 242 to monitor and control the paint sprayer so that even amounts of paint are dispersed at all times.

After the paint spray stage, the workpiece is transported to a bake oven 280 where the freshly coated workpiece is dried a second time. Temperature sensor 282 allows the controller 242 to monitor the temperature of the oven. Burner 284 and airflow switch 286 allow the controller 242 to control the temperature of the oven to ensure that the actual temperature remains within desired parameters for drying the workpiece. If the oven temperature strays below the desired temperature setpoint, the controller 242 can heat the oven by actuating the burner 284. If the oven temperature strays above the desired temperature setpoint, the controller 242 can vent the oven by opening the airflow switch 286.

The apparatus 240 of FIG. 16 also comprises a communication device which is capable of generating various types of alarms via an alarm 288, and further capable of providing remote access to the control apparatus via a modem 290 so that individuals who are removed from the immediate vicinity of the treatment controlling apparatus 240 can access, monitor and/or control the system from wherever they are. In addition to notifying the individuals working on or near the treatment controlling apparatus 240 to see and/or hear an alarm 288, the communication device also can be set up to notify someone off site or away from the apparatus 240 about alarms via the modem 290.

The remote access to the apparatus 240 may also be set up to allow for additional parties, such as the apparatus manufacturer, to be notified of any alarms and/or to gain access to the apparatus 240 so that they might provide better customer service or technical assistance.

Additional communication terminals 292 and 294 may be provided to allow access to the apparatus 240 from various other locations. For example, communication terminal 292 is depicted as a touch-screen display which would offer an operator access to the controller 240 to alter or monitor setpoint parameter values. Similarly, communication terminal 294 is depicted as a graphics personal computer workstation with attached printer. Such a terminal would allow an operator to access or monitor the apparatus 240, and would also allow the operator to print out reports, logs, or specification settings from the terminal for use elsewhere.

The apparatus 240 of FIG. 16 may also comprise a security component which requires entry of a password or authorized code in order to gain access to the apparatus and/or alter the desired values or parameters. Such a feature serves to minimize the risk of accidental or intentional tampering with the specification settings (or desired parameters) and assists the apparatus 240 in providing accurate and reliable monitoring and/or control of the treatment process.

Figure 17:
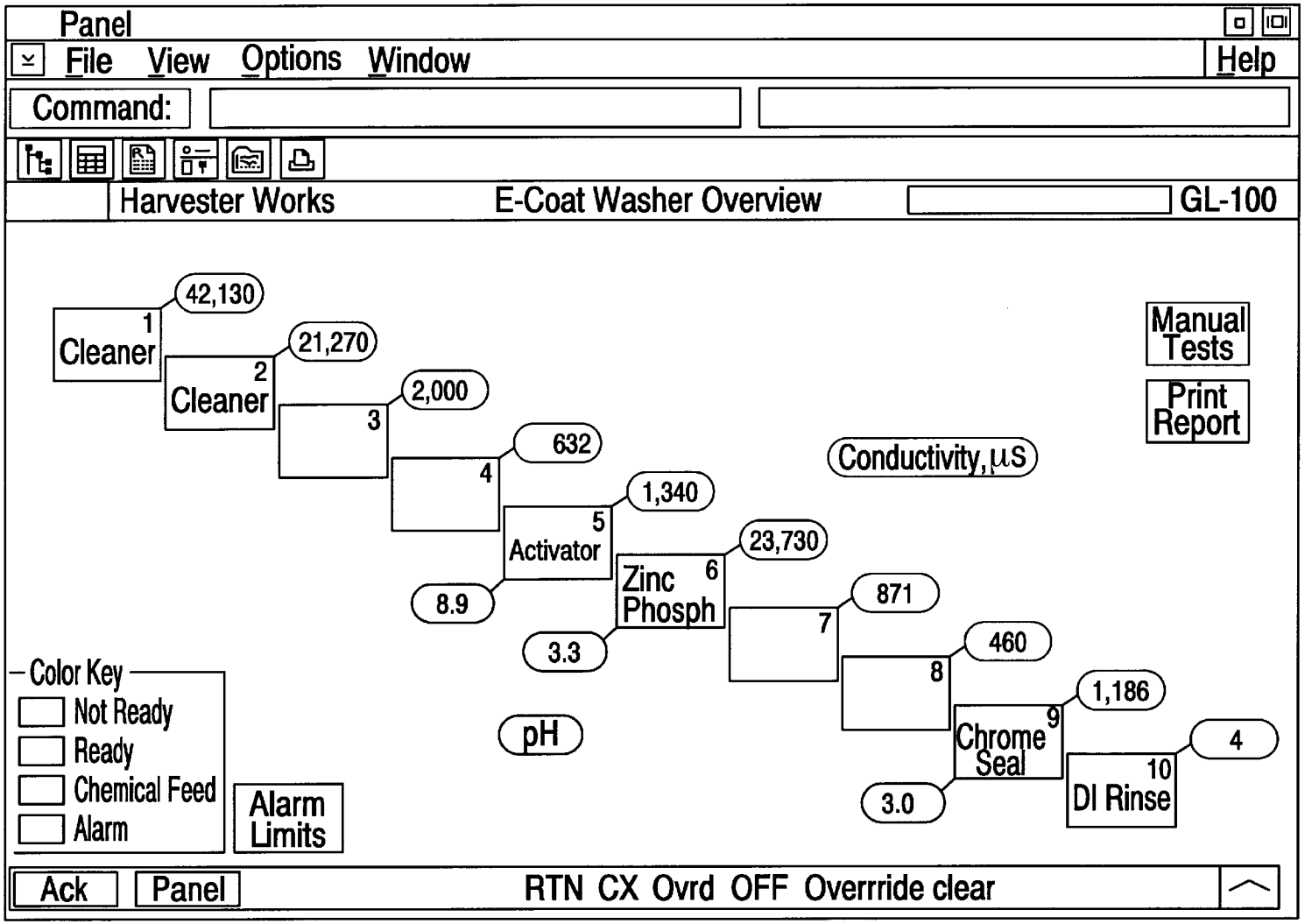
FIG. 17 is a screen print of the system overview screen from the graphics package operating on the workstation of FIG. 2.

Turning now to FIG. 17, in which a print out of a systems overview screen from the graphics software package operating on the workstation of FIG. 2 is shown. This screen shows all current data and the status of each stage. There is a key showing the different status levels located in the lower left-hand portion of the screen, and the data presented comprises the following:

| Label | Parameter | Units |
|---|---|---|
| pH | Solution pH | pH units |
| Conductivity | Solution Conductivity | $\mu$S |
| Temperature | Solution Temperature | Fahrenheit |
| Alarm | Control Point Status | |
| Feed Mode | Chemical Pump Status | |

The systems overview screen is continuously updated until an operator clicks on one of the washer stages on the screen to go to the specified stage or feature. From this screen, an operator is able to access individual stage screens where he or she can get details about the specific stage and change various parameters or setpoints as needed.

Figure 18:
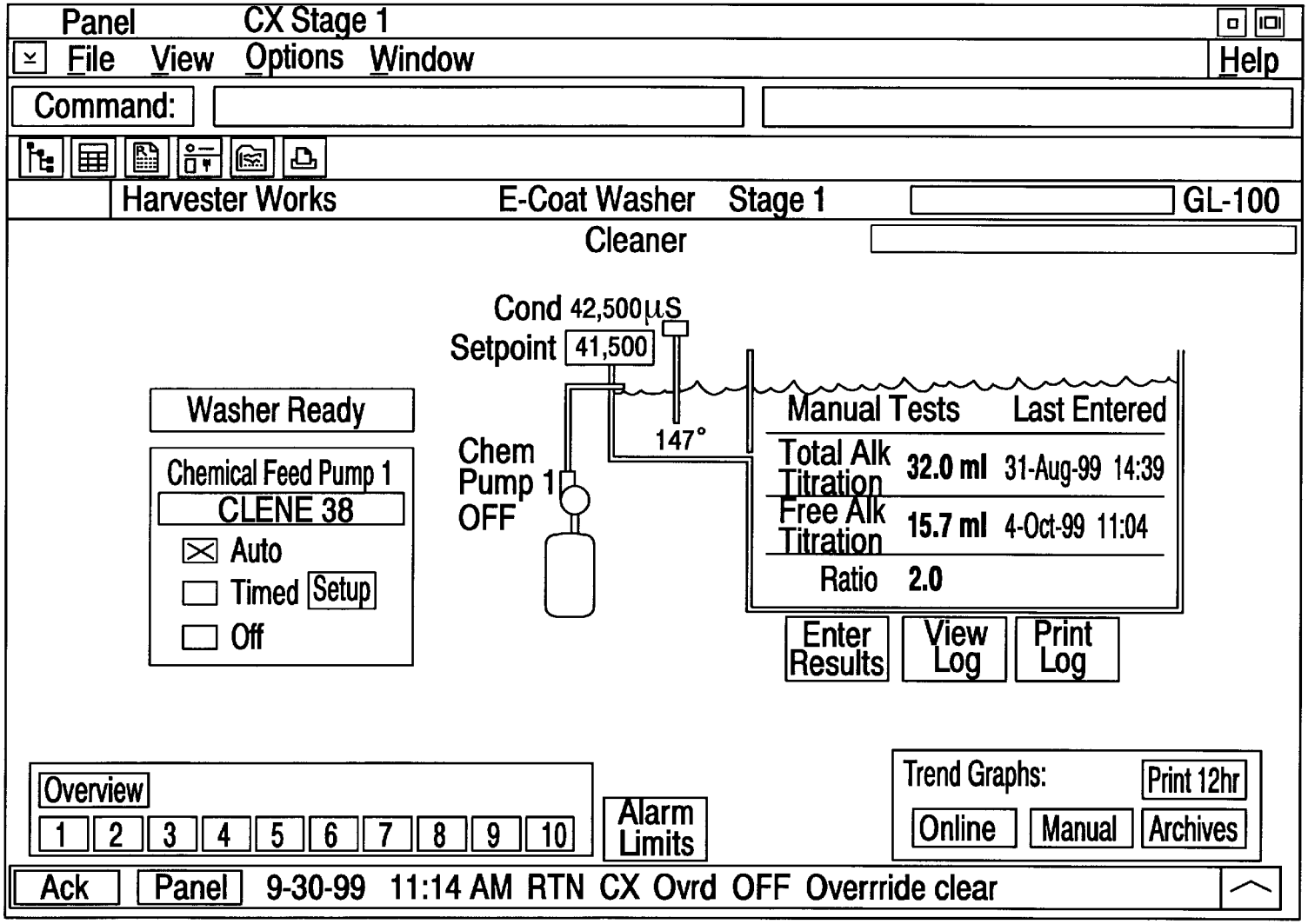
FIG. 18 is a screen print of one of the individual stage screens from the graphics package operating on the workstation of FIG. 2.

FIG. 18 is a screen print of one of the individual stage screens from the graphics package operating on the workstation of FIG. 2. As depicted in FIG. 2, the individual stage screens have many accessible secondary screens having links on the individual stage screen. These secondary screens give further information about the individual stage screen and allow for deeper analysis of the process within the stage. The enter results button accesses a secondary screen where titrations can be entered into the system for the stage. The view log button shows a log of those titrations entered for the stage. The alarm limits button shows the ranges for all control points that have alarms connected to them. A setpoint box is located in the middle of the screen for the first, second, fifth, sixth and ninth stages and can be accessed to change the desired parameters or setpoints of the system. When the setpoint box is selected, a calculator appears on the screen so that the operator can enter the new setpoint.

Each stage has the capability of accessing secondary screens that show graphs of all the control points associated with the stage, (e.g., pH, conductivity, total acid, chemical pump status, temperature, etc.). These graphs can be seen by clicking the online and manual buttons in the bottom right-hand corner of the individual stage screen. The print 12 hr button, which is also located in the bottom right-hand corner, will print a twelve hour history of the control point data for the stage.

Another capability of each individual stage screen, which is located in the bottom left-hand corner of the screen, is that the overview and each stage can be accessed from any of the individual stage screens by selecting the appropriate overview or stage button.

Figure 19:
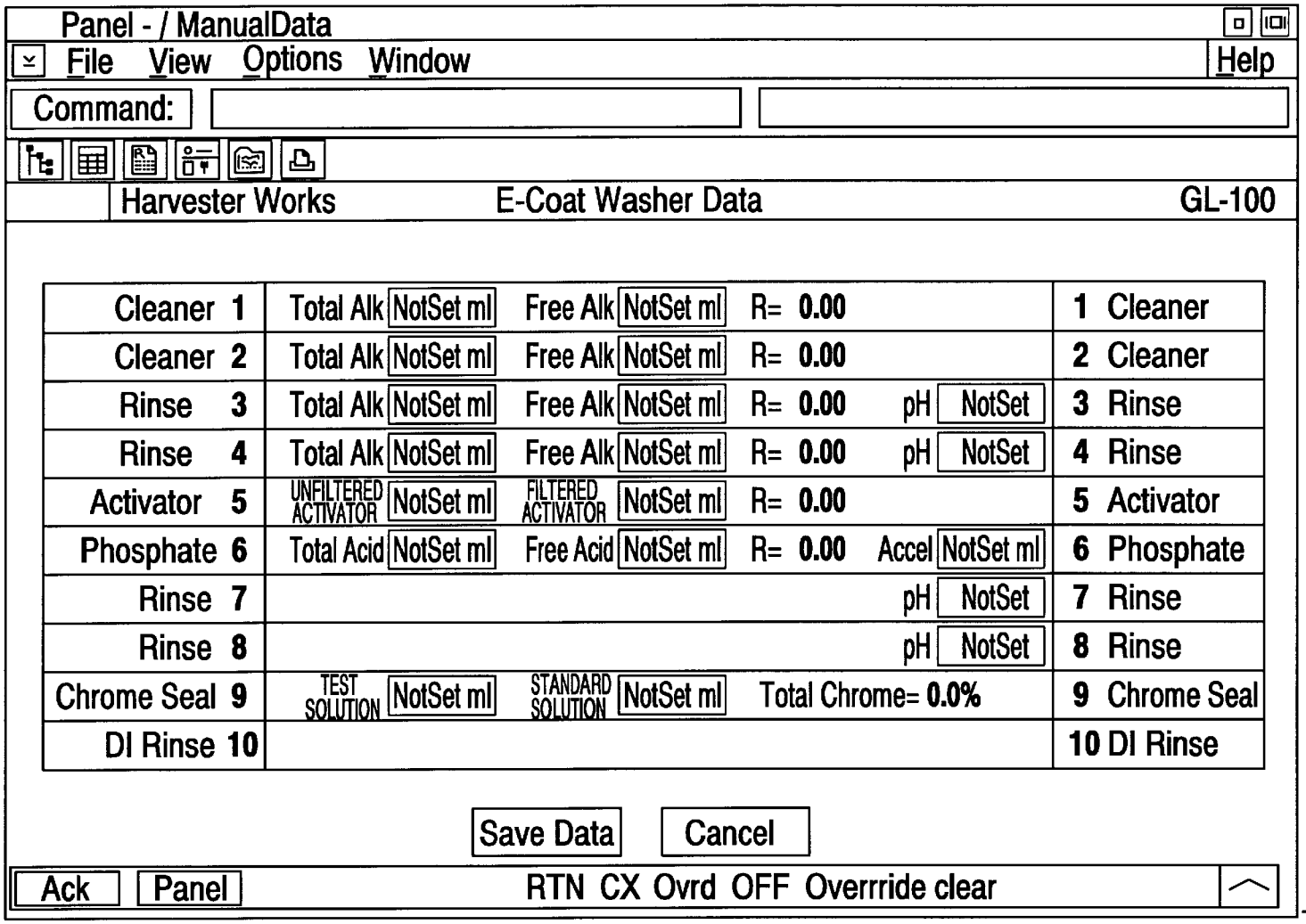
FIG. 19 is a screen print of one of the titration screens from the graphics package operating on the workstation of FIG. 2.

FIG. 19 is a screen print of one of the titration screens from the graphics package operating on the workstation of FIG. 2. By clicking the enter results button on the individual stage screen, an operator can access the titration screen to enter the values of the titrations for that particular stage. Within this secondary screen, an operator may click on the box for which the titration value needs to be entered, (e.g., total acid, free alkalinity, etc.), and a calculator will appear so that the operator can enter the titration value. Once the new value has been entered, the titration screen will be updated, and after all titration values have been added, the operator can select the save data button at the bottom of the titration screen so that this data will be permanently saved in the system. After this has occurred, the titration secondary screen will close and the individual stage screen will reappear with the updated titration values showing.

Figure 20:
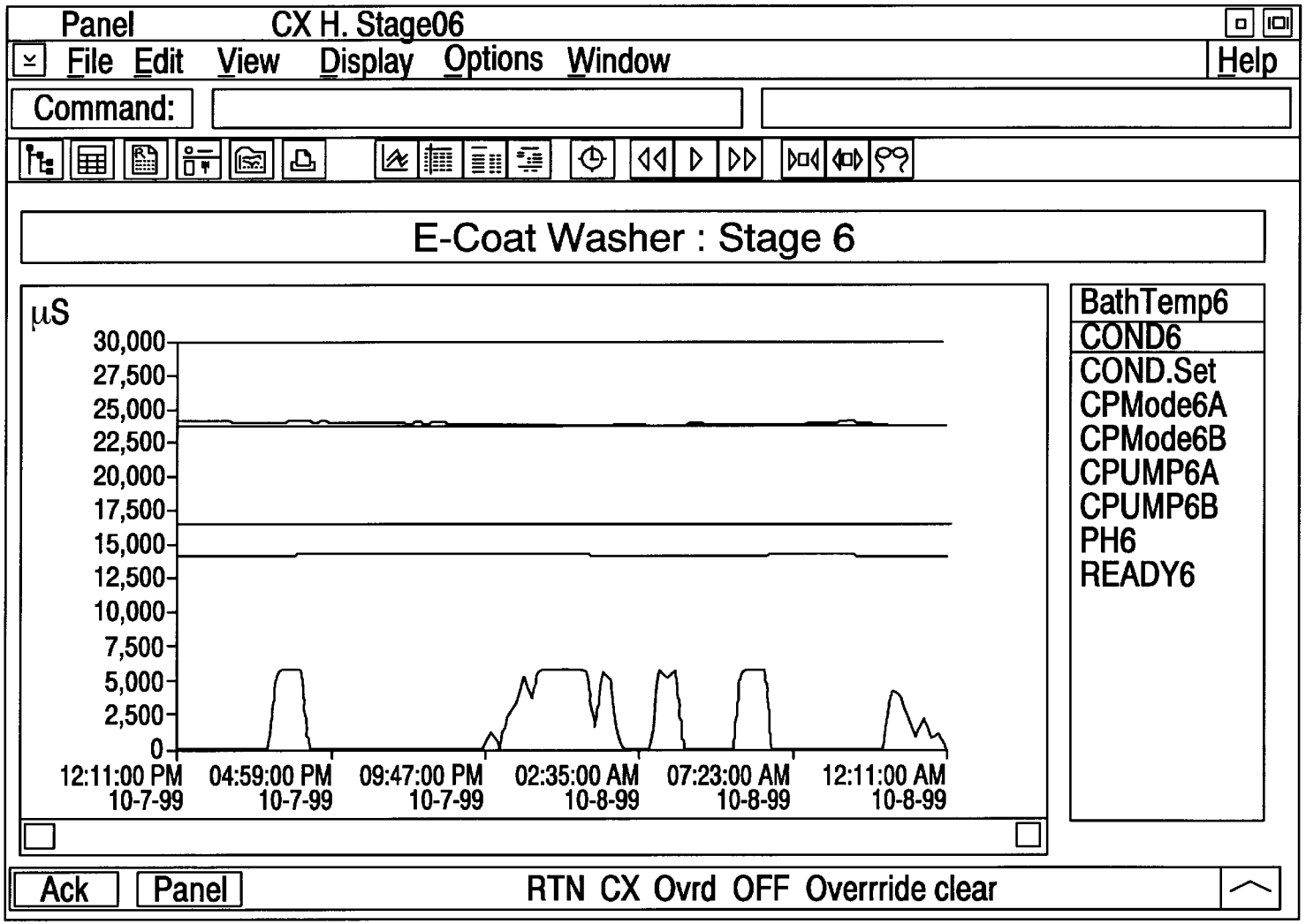
FIG. 20 is a screen print of one of the graph screens from the graphics package operating on the workstation of FIG. 2.

FIG. 20 is a screen print of one of the graph screens from the graphics package operating on the workstation of FIG. 2. The operator can access secondary graph screens by selecting the online and/or manual buttons on the individual stage screens. Graphs of all control points within a stage appear on the graph screen. Since the screen may get cluttered if several data points exist, the operator has the option to select any of the control points observed to view the data more clearly by selecting the desired control point from the list of control points on the right-hand side of the screen and hitting the eyeglass button from the icon menu located at the top of the screen. After doing so, all of the other control points will disappear until the eyeglass button is selected again. Thus, the operator is able to view the particular control points data more clearly. If the operator wishes to view or compare selected control points to each other, he or she can select all of the unwanted control points and press the control and h buttons from the keyboard to remove these control points.

The graph data can be narrowed down to half of its size by button having two arrows pointing towards each other located in the icon menu at the top of the screen. The operator can narrow the graph even further by selecting this button a second time. In order to widen the graph, (or restore it to its original size), the operator can select the button having two arrows pointing away from each other which is also located in the icon menu at the top of the screen. These buttons help to achieve better viewing of selected periods of time on the graph.

Another feature of the graph screen is that the operator can pan and scan the graphical data presented by selecting the clock button located in the icon menu at the top of the screen. Once selected, a new screen appears in which the operator is asked for a start time and end time for the graph to be produced. After these dates have been entered, the desired graph is displayed. To pan and scan the graph, the operator can select from the reverse, play, or fast forward buttons provided in the icon menu at the top of the screen. The play button will allow the operator to pan through the graphical data from start to finish. The reverse button will allow the operator to scan back through the graphical data without going through the panning feature until the start point has been reached. The fast forward button will allow the operator to scan forward through the graphical data without going through the panning feature until the end point has been reached. These features provide for a quick way to search for problems or irregularities that may have occurred during the treatment process.

The operator can review the data that the graph has been generated from by selecting the graph button located in the icon menu at the top of the screen. The data will appear in a numeric spreadsheet format compiled from the data collected in fifteen-minute increments over the course of the past twenty four hours. Data from longer periods of time can be retrieved by selecting the clock button, following the procedures discussed above for defining the period of time, and selecting the graph button again.

Figure 21:
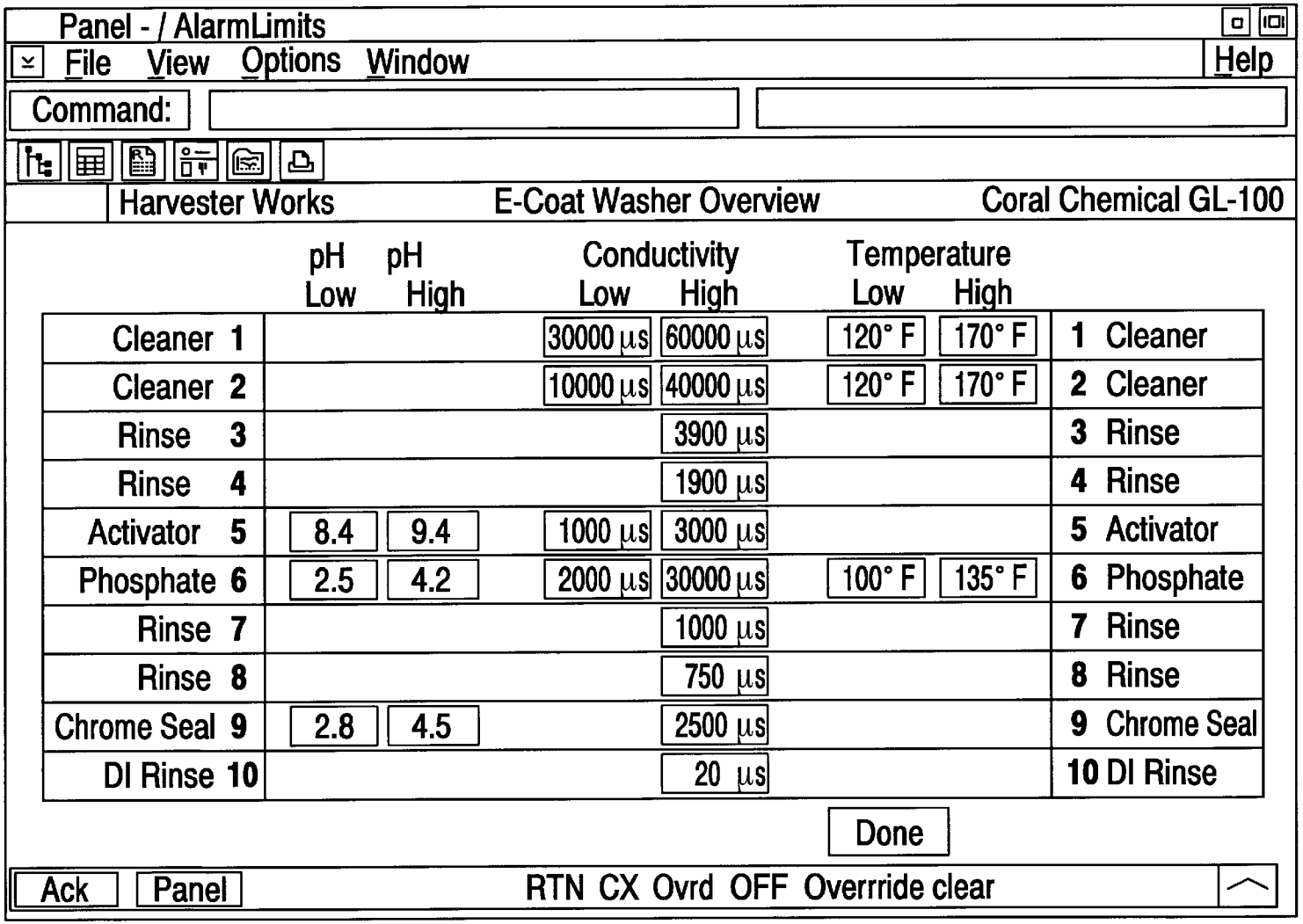
FIG. 21 is a screen print of one of the alarm limits screens from the graphics package operating on the workstation of FIG. 2.

FIG. 21 is a screen print of one of the alarm limits screens from the graphics package operating on the workstation of FIG. 2. By selecting the alarm limits button from the overview or stage screens, the operator can review and change the ranges at which the system will run without being in the alarm mode. Alarms will go off if any of the control points have values higher or lower than the ranges shown on the alarm limits screen. By clicking on any of the alarm limit boxes, a calculator will appear and allow the operator to enter the desired parameter or setpoint values, (e.g., settings for total acid, free alkalinity, temperature, etc.). Alarm notifications will be generated if the any of the monitored parameters (or conditions) stray from the setpoints. For example, the operator may be notified if the pH, conductivity, bath temperature, etc. are out of range or are lagging from their setpoint values.

Thus it is apparent that there has been provided, in accordance with the invention, an apparatus for controlling treatment of metal that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A method of treating metal using an apparatus having sensors and a controller for selectively monitoring the sensors and controlling output actuators of a multi-staged metal treatment process to more accurately and reliably administer treatment, the method comprising:

cleaning a metal workpiece with an alkaline solution in a first stage;

applying an ionic conditioner to the workpiece in a second stage;

applying a phosphate solution to the workpiece in a third stage;

applying a finishing overcoat in an ionic aqueous sealing agent to the workpiece in a fourth stage;

monitoring temperature and conductivity of the alkaline solution in the first stage, conductivity and pH of the conditioner in the second stage, temperature, conductivity and pH of the solution in the third stage, and conductivity and pH of the agent in the fourth stage; and generating an alarm if any of the monitored parameters vary from desired parameters for a predetermined amount of time; and actuating output actuators if an alarm is generated to maintain the desired parameters for the metal treatment process.

2. A method according to claim 1, wherein the method further comprises:

providing remote access, monitoring and controlling features which allow individuals who are removed from the immediate vicinity of the treatment controlling apparatus to access, monitor, control the treatment control apparatus.

* * * * *